US008733890B2

(12) United States Patent
Maida

(10) Patent No.: US 8,733,890 B2
(45) Date of Patent: May 27, 2014

(54) NOZZLE SURFACE CLEANING APPARATUS AND DROPLET EJECTION APPARATUS

(75) Inventor: Noriaki Maida, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 3 days.

(21) Appl. No.: 13/208,019

(22) Filed: Aug. 11, 2011

(65) Prior Publication Data

US 2012/0038707 A1 Feb. 16, 2012

(30) Foreign Application Priority Data

Aug. 12, 2010 (JP) ..... 2010-181045

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 6,033,052 | A * | 3/2000 | Muraki | 347/33 |
| 6,250,736 | B1 | 6/2001 | Wojcik | |
| 2003/0081047 | A1* | 5/2003 | Yearout | 347/28 |
| 2008/0158291 | A1 | 7/2008 | Satake | |
| 2009/0147045 | A1 | 6/2009 | Muraoka | |
| 2009/0189945 | A1* | 7/2009 | Sekiyama | 347/33 |
| 2009/0219335 | A1 | 9/2009 | Furukawa | |
| 2010/0214355 | A1* | 8/2010 | Inoue | 347/28 |
| 2011/0043567 | A1* | 2/2011 | Jung et al. | 347/33 |

FOREIGN PATENT DOCUMENTS

| | | | |
|---|---|---|---|
| JP | 2001-63076 | A | 3/2001 |
| JP | 2008-179125 | A | 8/2008 |
| JP | 2009-137156 | A | 6/2009 |
| JP | 2009-196293 | A | 9/2009 |
| JP | 2010-5857 | A | 1/2010 |

OTHER PUBLICATIONS

Office Action for related Japanese Application No. 2010-181045 issued Sep. 9, 2013 with an English translation.

* cited by examiner

*Primary Examiner* — Alejandro Valencia
(74) *Attorney, Agent, or Firm* — Birch, Stewart, Kolasch & Birch, LLP

(57) ABSTRACT

A nozzle surface cleaning apparatus is configured to clean a nozzle surface of a droplet ejection head while moving relatively with respect to the droplet ejection head. The apparatus includes: a cleaning liquid deposition device which deposits cleaning liquid to the nozzle surface; a blade which is pressed against the nozzle surface to wipe the nozzle surface; a drip guiding member which guides waste liquid wiped by the blade to drip to a predetermined drip position set inside of the blade than an end of the blade; and a receptor which receives the waste liquid dripping from the drip guiding member.

10 Claims, 21 Drawing Sheets

NOZZLE SURFACE CLEANING APPARATUS AND DROPLET EJECTION APPARATUS

BACKGROUND OF THE INVENTION

1. Field of the Invention

The present invention relates to a nozzle surface cleaning apparatus and a droplet ejecting apparatus, and more particularly to a nozzle surface cleaning apparatus and a droplet ejecting apparatus which apply cleaning liquid to a nozzle surface and then wipe and clean the nozzle surface with a blade.

2. Description of the Related Art

When a recording operation is carried out continuously in an inkjet recording apparatus, ink adheres and accumulates in the vicinity of the nozzles and blockages occur in the nozzles. The nozzle blockages greatly decrease the print quality and therefore in the inkjet recording apparatus, cleaning of the nozzle surface of the head is carried out periodically. The cleaning of the nozzle surface is performed by, for example, wiping the nozzle surface with a blade (wiper) (see, for example, Japanese Patent Application Publication Nos. 2009-137156 and 2001-063076).

When the nozzle surface is wiped with the blade, there is a problem in that waste liquid scraped off by the blade drips from the blade and stains surroundings. Hence, the inkjet recording apparatus which wipes the nozzle surface with the blade is provided with a receptor (as in Japanese Patent Application Publication No. 2009-137156) or an absorber (as in Japanese Patent Application Publication No. 2001-063076) under the blade.

It is preferable to arrange the receptor or absorber over a wide range so as to ensure that waste liquid is trapped; however, it disadvantageously increases apparatus size.

SUMMARY OF THE INVENTION

The present invention has been contrived in view of these circumstances, an object thereof being to provide a nozzle surface cleaning apparatus and a droplet ejecting apparatus which enable waste liquid to be reliably recovered with a compact configuration.

In order to attain the aforementioned object, the present invention is directed to a nozzle surface cleaning apparatus configured to clean a nozzle surface of a droplet ejection head while moving relatively with respect to the droplet ejection head, the apparatus comprising: a cleaning liquid deposition device which deposits cleaning liquid to the nozzle surface; a blade which is pressed against the nozzle surface to wipe the nozzle surface; a drip guiding member which guides waste liquid wiped by the blade to drip to a predetermined drip position set inside of the blade than an end of the blade; and a receptor which receives the waste liquid dripping from the drip guiding member.

According to this aspect of the present invention, the waste liquid that drips from the blade when the nozzle surface is wiped by the blade is guided by the drip guiding member to drip to the predetermined drip position. Hence, by installing the receptor at the drip position, the waste liquid can be reliably recovered without staining the surroundings. Moreover, by arranging the drip position on the inner side of an end part of the blade, a necessary width of the receptor can be kept within the width of the blade and a compact apparatus can be realized.

Preferably, the droplet ejecting head is arranged with the nozzle surface being inclined.

According to this aspect of the present invention, the nozzle surface is inclined. If the nozzle surface is inclined or not horizontal, when the nozzle surface is wiped with the blade, the waste liquid drips from the lower end part in the inclination direction. In this case, in order to reliably recover the waste liquid, the receptor might be installed sticking outward from the lower end of the blade. However, according to the present invention, the waste liquid is guided to drip on the inner side of the blade by the drip guiding member. Therefore, the waste liquid can be reliably recovered even if the receptor is not installed sticking outward from the lower end of the blade.

Preferably, the drip guiding member is integrally formed with a blade supporting member which supports the blade.

According to this aspect of the present invention, the drip guiding member is integrally formed with the blade supporting member that supports the blade. In other words, the blade supporting member also serves as the drip guiding member. Consequently, the number of parts can be reduced and assembly can be performed more easily.

In order to attain the aforementioned object, the present invention is also directed to a nozzle surface cleaning apparatus configured to clean a nozzle surface of a droplet ejection head while moving relatively with respect to the droplet ejection head, the apparatus comprising: a cleaning liquid deposition device which deposits cleaning liquid to the nozzle surface; a blade which is pressed against the nozzle surface to wipe the nozzle surface; a wiping device which presses a band-shaped wiping web against the nozzle surface to wipe the nozzle surface with the wiping web traveling; and a drip guiding member which guides waste liquid wiped by the blade to drip onto the wiping web.

According to this aspect of the present invention, the waste liquid that drips from the blade when the nozzle surface is wiped by the blade is guided by the drip guiding member to drip onto the wiping web that wipes the nozzle surface. Consequently, the waste liquid can be reliably recovered without staining the surroundings. Moreover, since a receptor or the like need not be arranged separately, the apparatus configuration can be simplified.

Preferably, the droplet ejecting head is arranged with the nozzle surface being inclined.

According to this aspect of the present invention, even when the nozzle surface is arranged inclined or not horizontal, the waste liquid can be reliably recovered without staining the surroundings.

Preferably, the blade is arranged so as to wipe a lower end region in an inclination direction of the nozzle surface.

According to this aspect of the present invention, the blade is arranged so that only the lower end region in the inclination direction of the nozzle surface is wiped. Since the nozzle surface is eventually wiped by the wiping web, wiping only necessary regions by the blade is to suffice. When the nozzle surface is inclined, the cleaning liquid pools at the lower end portion of the nozzle surface in the inclination direction. When the nozzle surface is wiped by the wiping web in this state, there is a risk that the cleaning liquid which pools at the lower end portion in the inclination direction cannot be completely wiped off and that the waste liquid may remain on the nozzle surface. Therefore, by wiping off the cleaning liquid pooled at the lower end portion in the inclination direction of the nozzle surface by the blade before wiping by the wiping web, the nozzle surface can be reliably wiped by the wiping web. Furthermore, in doing so, by causing the waste liquid wiped by the blade to drip onto the wiping web, the nozzle surface can be wiped without staining the surroundings.

Preferably, the drip guiding member is integrally formed with a blade supporting member which supports the blade.

According to this aspect of the present invention, the drip guiding member is integrally formed with the blade supporting member that supports the blade. In other words, the blade supporting member also serves as the drip guiding member. Consequently, the number of parts can be reduced and assembly can be performed more easily.

Preferably, the blade is arranged above a travel pathway of the wiping web, and the drip guiding member causes the waste liquid wiped by the blade to drip onto the wiping web.

According to this aspect of the present invention, the blade is arranged above the travel pathway of the wiping web and the wiped waste liquid is guided by the drip guiding member so as to drip onto the wiping web. Consequently, the waste liquid can be reliably recovered with a compact configuration.

Preferably, the drip guiding member guides the waste liquid to drip onto the wiping web that has wiped the nozzle surface.

According to this aspect of the present invention, the waste liquid drips onto the wiping web after the wiping web wipes the nozzle surface. Therefore, the waste liquid can be recovered without staining the wiping web prior to wiping.

Preferably, the wiping web travels in an opposite direction to a movement direction of the nozzle surface relative to the nozzle surface cleaning apparatus.

According to this aspect of the present invention, the nozzle surface is wiped by the wiping web that travels in the opposite direction to the direction of movement of the nozzle surface. Therefore, the nozzle surface can be wiped in an efficient manner. Moreover, even if the blade is arranged on a stage preceding the wiping web, the waste liquid can be caused to drip onto the wiping web after wiping.

In order to attain the aforementioned object, the present invention is also directed to a droplet ejection apparatus, comprising: the above-described nozzle surface cleaning apparatus; and the droplet ejection head which ejects droplets onto a medium.

According to this aspect of the present invention, since the nozzle surface cleaning apparatus with a compact configuration can be incorporated, an overall configuration of the droplet ejecting apparatus can also be compactified.

According to the present invention, the waste liquid can be reliably recovered with the compact configuration.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, an example is described in which a nozzle surface cleaning apparatus according to an embodiment of the present invention is incorporated in an inkjet recording apparatus which records an image on a cut sheet of paper.

Composition of Image Recording Unit of Inkjet Recording Apparatus

Figure 1:
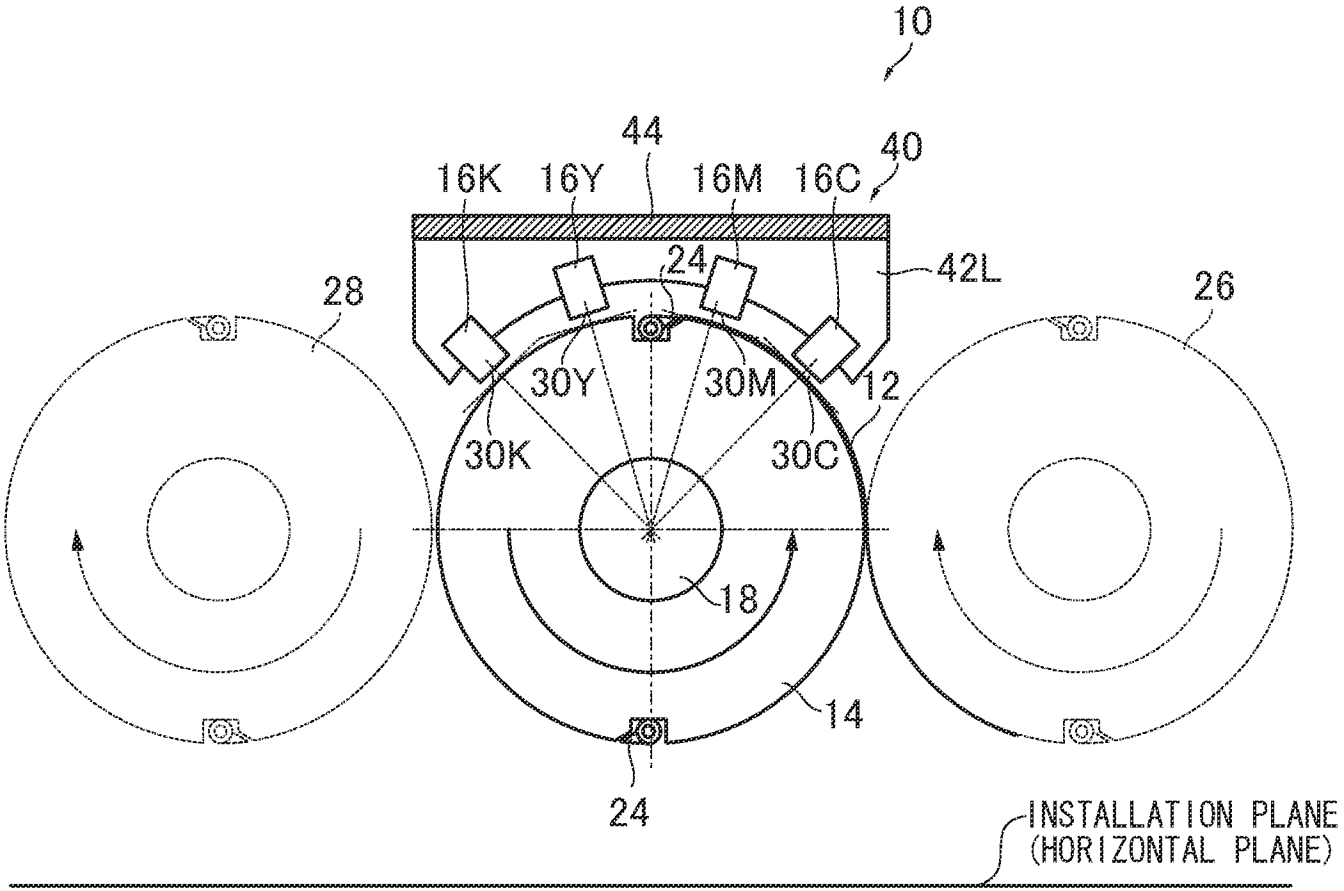
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, the image recording unit 10 of the inkjet recording apparatus according to the present embodiment conveys a medium (cut sheet of paper) 12 by means of an image recording drum 14. Droplets of inks of respective colors of cyan (C), magenta (M), yellow (Y), black (K) are ejected and deposited on a surface of the medium 12 from inkjet heads (droplet ejection heads) 16C, 16M, 16Y and 16K, which are arranged about the periphery of the image recording drum 14, whereby a color image is recorded on the surface of the medium 12.

Figure 2:
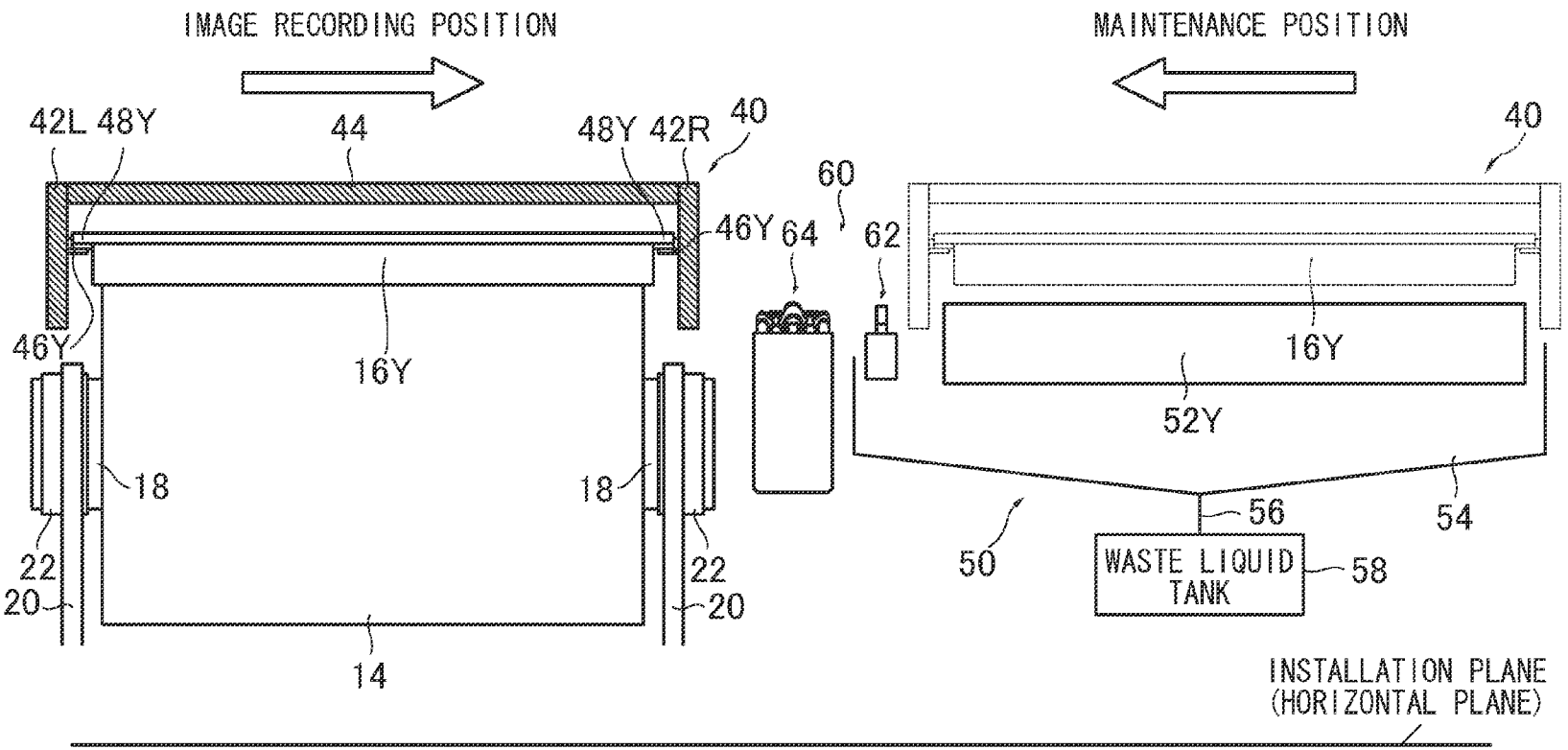
FIG. 2 is a front view diagram of the image recording unit of the inkjet recording apparatus.

The image recording drum 14 is arranged rotatably, and end portions of a rotating shaft 18 of the image recording drum 14 are supported on a pair of bearings 22 (see FIG. 2). The bearings 22 are arranged on a main frame 20 of the inkjet recording apparatus, and due to the end portions of the rotating shaft 18 being supported on this pair of bearings 22, the image recording drum 14 is installed horizontally (the rotating shaft 18 is installed in parallel with the horizontal installation surface).

A motor is coupled to the rotating shaft 18 of the image recording drum 14 through a rotation transmission mechanism (not illustrated). The image recording drum 14 is driven by the motor to rotate.

The image recording drum 14 is provided with grippers 24 arranged on the circumferential surface thereof (in the present embodiment, at two locations on the outer circumferential surface thereof) so as to grip a leading end portion of the medium 12. The leading end portion of the medium 12 is gripped by the grippers 24 and thereby held on the outer circumferential surface of the image recording drum 14.

The image recording drum 14 is further provided with an attraction holding mechanism which is not illustrated (for example, an electrostatic attraction mechanism or a vacuum suction mechanism). The medium 12 which is wrapped about the outer circumferential surface of the image recording drum 14 and the leading end portion of which is gripped by the gripper 24 is held by attraction on the rear surface side thereof by the attraction holding mechanism and thereby held on the outer circumferential surface of the image recording drum 14.

In the inkjet recording apparatus according to the present embodiment, the medium 12 is transferred to the image recording drum 14 through a conveyance drum 26 from a previous step. The conveyance drum 26 is disposed in parallel with the image recording drum 14 and transfers the medium 12 onto the image recording drum 14 in a synchronized fashion.

Furthermore, the medium 12 after the image recording is transferred to a subsequent step through a conveyance drum 28. The conveyance drum 28 is disposed in parallel with the image recording drum 14 and receives the medium 12 from the image recording drum 14 in a synchronized fashion.

The four inkjet heads 16C, 16M, 16Y and 16K are constituted of line heads having widths corresponding to the width of the medium, and are arranged at uniform intervals apart radially on a circle concentric with the rotating shaft 18 of the image recording drum 14.

In the present embodiment, the four inkjet heads 16C, 16M, 16Y and 16K are arranged horizontally symmetrically about the image recording drum 14. In other words, the cyan inkjet head 16C and the black inkjet head 16K are disposed symmetrically with respect to the vertical line that passes through the center of the image recording drum 14, and the magenta inkjet head 16M and the yellow inkjet head 16Y are also disposed horizontally symmetrically with respect to the same vertical line.

Nozzle surfaces 30C, 30M, 30Y and 30K, which are formed at lower ends of the inkjet heads 16C, 16M, 16Y and 16K disposed as described above, are positioned so as to face the outer circumferential surface of the image recording drum 14, and the nozzle surfaces 30C, 30M, 30Y and 30K are disposed at a prescribed height position from the outer circumferential surface of the image recording drum 14 (a uniform gap is formed between the outer circumferential surface of the image recording drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the medium 12.

Ink droplets are ejected perpendicularly toward the outer circumferential surface of the image recording drum 14 from the nozzles which are formed on the nozzle surfaces 30C, 30M, 30Y and 30K of the inkjet heads 16C, 16M, 16Y, 16K disposed as described above.

Figure 3:
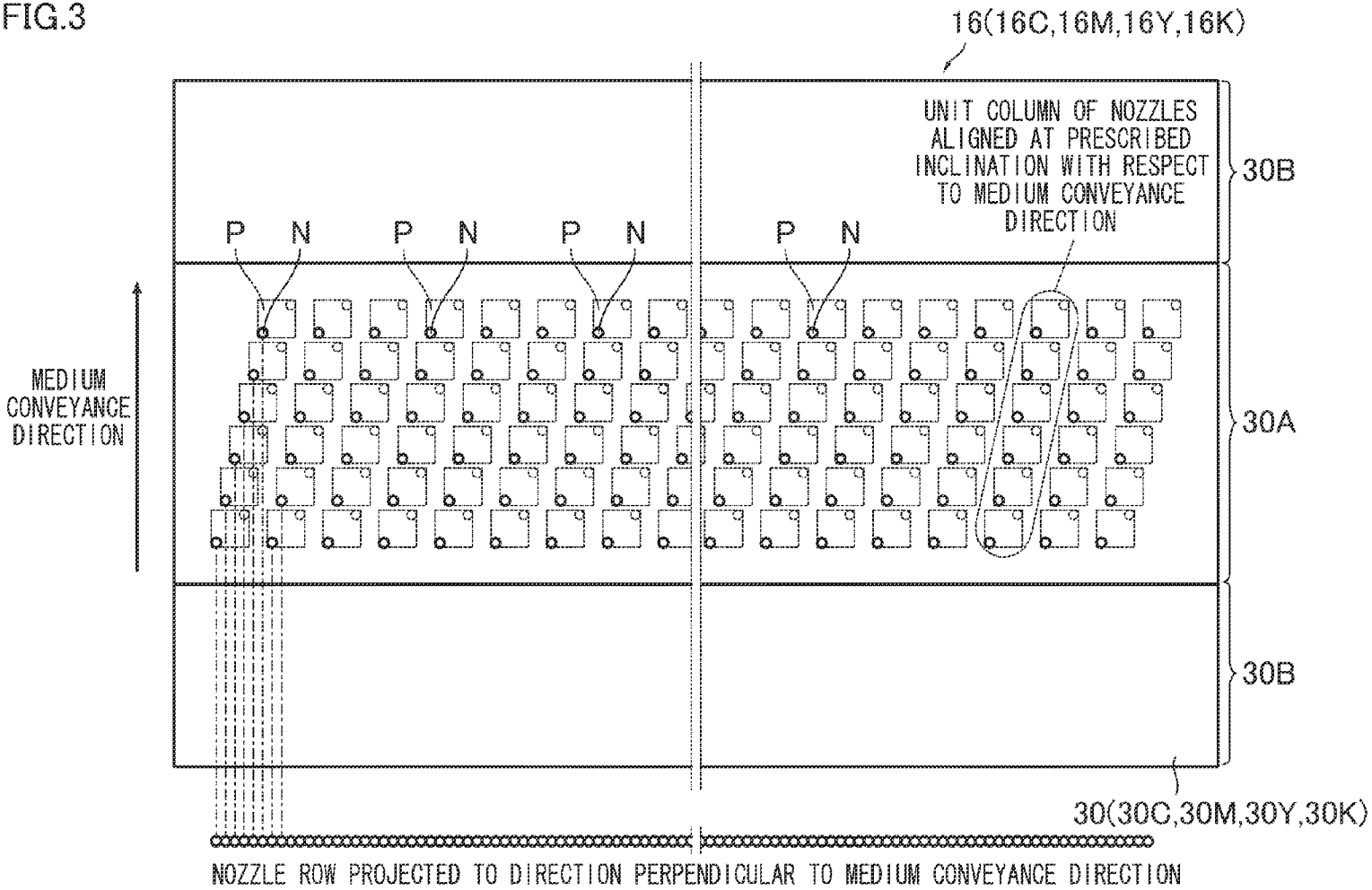
FIG. 3 is a plan view perspective diagram of a nozzle surface of an inkjet head.
Figure 4:
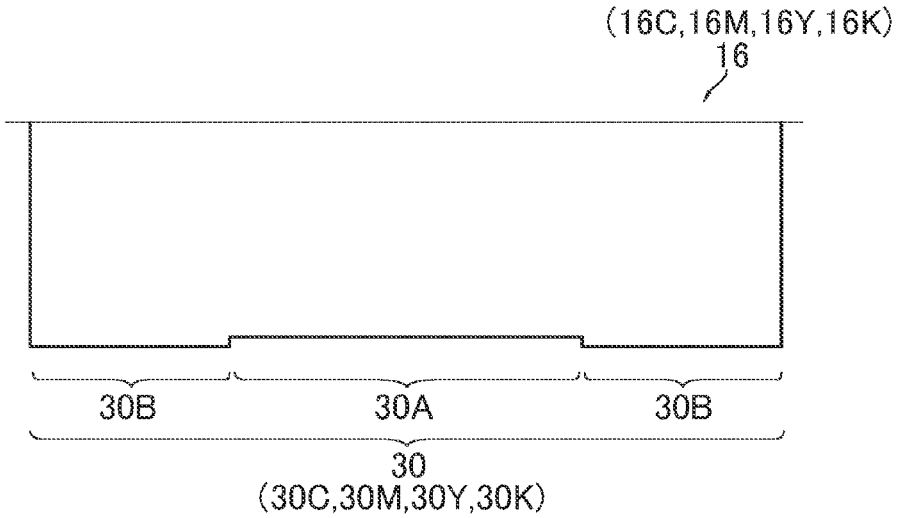
FIG. 4 is a side view diagram of a lower end region of the inkjet head.

FIG. 3 is a plan view perspective diagram of the nozzle surface of the inkjet head, and FIG. 4 is a side view diagram of the lower end region of the inkjet head.

The inkjet heads 16C, 16M, 16Y and 16K have the same composition, and therefore the composition of one inkjet head 16 and the nozzle surface 30 (30C, 30M, 30Y, 30K) thereof is described here.

As shown in FIG. 3, the nozzle surface 30 is formed in a rectangular shape and includes a nozzle forming region 30A having a fixed width in the central portion of the breadthwise direction thereof (media conveyance direction) and nozzle protecting regions 30B arranged symmetrically on either side of the nozzle forming region 30A.

The nozzle forming region 30A is a region where nozzles are formed and a prescribed liquid repelling treatment is applied on the surface of this region (a liquid repelling film is applied thereon).

Here, as shown in FIG. 3, the inkjet head 16 according to the present embodiment is composed as a so-called matrix head and nozzles N are arranged in a two-dimensional matrix configuration in the nozzle forming region 30A. More specifically, the nozzle rows are formed by arranging the nozzles N at a uniform pitch in a direction inclined by a prescribed angle with respect to the direction of conveyance of the medium 12, and furthermore a plurality of the nozzle rows are arranged at uniform pitch in the direction perpendicular to the conveyance direction of the medium 12. By adopting this arrangement for the nozzles, it is possible to reduce the effective pitch between the nozzles N as projected to the lengthwise direction of the head (namely, a direction perpendicular to the conveyance direction of the medium 12), and therefore a high-density configuration of the nozzles N can be achieved.

In the matrix heads, the effective nozzle row is a row of nozzles projected to the lengthwise direction of the head.

The nozzle protecting regions 30B arranged on either side of the nozzle forming region 30A are regions for protecting the nozzle forming region 30A, and the nozzle forming region 30A is formed as a receding part that recedes by a prescribed amount (approximately 0.2 mm) from the nozzle protecting regions 30B.

The inkjet head 16 according to the present embodiment has the liquid repelling treatment applied only on the nozzle forming region 30A (no liquid repelling treatment is applied on the nozzle protecting regions 30B). In this case, when liquid adheres to the nozzle protecting regions 30B, the liquid wets and spreads on the nozzle protecting regions 30B.

The inkjet head 16 according to the present embodiment ejects droplets of ink from the nozzles N by a so-called piezoelectric jet system. The nozzles N formed in the nozzle surface 30 are respectively connected to pressure chambers P, and droplets of the ink are ejected from the nozzles N by expanding and contracting the volume of the pressure chambers P by causing the side walls of the pressure chambers P to vibrate by means of the piezoelectric elements.

The ink ejection method is not limited to this and may also adopt a composition which performs ejection by a thermal method.

The image recording unit 10 has the composition described above. In the image recording unit 10, the medium 12 is received onto the image recording drum 14 from the previous step through the conveyance drum 26, and is conveyed in rotation while being held by attraction on the circumferential surface of the image recording drum 14. The medium 12 passes below the inkjet heads 16C, 16M, 16Y and 16K during this conveyance and ink droplets are ejected and deposited from the inkjet heads 16C, 16M, 16Y and 16K onto the recording surface of the medium 12 as the medium 12 passes, thereby forming a color image on the recording surface of the medium 12. After having completed the image recording, the medium 12 is transferred from the image recording drum 14 to the conveyance drum 28 and is conveyed to the subsequent step.

In the image recording unit 10 having the composition described above, the inkjet heads 16C, 16M, 16Y and 16K are installed on a head supporting frame 40 and are arranged around the image recording drum 14 as shown in FIG. 2.

The head supporting frame 40 is constituted of a pair of side plates 42L and 42R, which are arranged perpendicularly to the rotating shaft 18 of the image recording drum 14, and a linking frame 44, which links the pair of side plate 42L and 42R together at the upper end portions thereof.

Each of the side plates 42L and 42R is formed in a plate shape, and the side plates 42L and 42R are disposed so as to face each other across the image recording drum 14. Installation sections 46C, 46M, 46Y and 46K for installing the respective inkjet heads 16C, 16M, 16Y and 16K are provided on the inner side faces of the pair of side plates 42L and 42R (only the installation section 46Y is depicted in FIG. 2 for convenience).

The installation sections 46C, 46M, 46Y and 46K are disposed at a uniform spacing apart radially on a circle concentric with the rotating shaft 18 of the image formation drum 14. The inkjet heads 16C, 16M, 16Y and 16K are installed on the head supporting frame 40 by fixing attachment sections 48C, 48M, 48Y and 48K, which are formed on the respective ends of the heads (only the attachment section 48Y is depicted in FIG. 2 for convenience) onto the installation sections 46C, 46M, 46Y and 46K. By installing the inkjet heads 16C, 16M, 16Y and 16K on the head supporting frame 40, the inkjet heads 16C, 16M, 16Y and 16K are disposed at uniform intervals apart radially on a circle concentric with the rotating shaft 18 of the image formation drum 14.

The head supporting frame 40 for installing the inkjet heads 16C, 16M, 16Y and 16K is arranged slidably in a direction parallel to the rotating shaft 18 of the image formation drum 14 by being guided by guide rails (not illustrated). The head supporting frame 40 is arranged movably between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16C, 16M, 16Y and 16K are disposed about the periphery of the image recording drum 14 and assume a state capable of image recording.

The maintenance position is set to a position where the inkjet heads 16C, 16M, 16Y and 16K are retracted from the image recording drum 14. A moisturizing unit 50 for moisturizing the inkjet heads 16C, 16M, 16Y and 16K is provided in this maintenance position.

The moisturizing unit 50 includes caps 52C, 52M, 52Y and 52K (only the cap 52Y is depicted in FIG. 2 for convenience) which cover the nozzle surfaces of the inkjet heads 16C, 16M, 16Y and 16K. When the inkjet heads 16C, 16M, 16Y and 16K are not used for a long time, or the like, the nozzle surfaces are covered with the caps 52C, 52M, 52Y and 52K. Thereby, ejection failure due to drying is prevented.

A pressurizing and suctioning mechanism (not illustrated) is provided for the caps 52C, 52M, 52Y and 52K, in such a manner that the interior of the nozzles can be pressurized and suctioned.

Moreover, a cleaning liquid supply mechanism (not illustrated) is provided for the caps 52C, 52M, 52Y and 52K, in such a manner that cleaning liquid can be supplied to the interior of the caps.

A waste liquid tray 54 is disposed in a position below the caps 52C, 52M, 52Y and 52K. The cleaning liquid supplied to the caps 52C, 52M, 52Y and 52K is discarded into the waste liquid tray 54 and is recovered into a waste liquid tank 58 through a waste liquid recovery pipe 56.

A nozzle surface cleaning apparatus 60 for cleaning the nozzle surfaces 30C, 30M, 30Y and 30K of the inkjet heads 16C, 16M, 16Y and 16K is arranged between the image recording position and the maintenance position. The nozzle surfaces 30C, 30M, 30Y and 30K of the inkjet heads 16C, 16M, 16Y and 16K are cleaned by the nozzle surface cleaning apparatus 60 while the inkjet heads are moved between the maintenance position and the image recording position.

Below, the composition of the nozzle surface cleaning apparatus 60 is described.

Composition of Nozzle Surface Cleaning Apparatus

As shown in FIG. 2, the nozzle surface cleaning apparatus 60 includes a cleaning liquid deposition device 62 and a wiping device 64. The cleaning liquid deposition device 62 deposits the cleaning liquid to the nozzle surfaces 30C, 30M, 30Y and 30K of the inkjet heads 16C, 16M, 16Y and 16K. The wiping device 64 wipes the nozzle surfaces 30C, 30M, 30Y and 30K on which the cleaning liquid has been deposited. The nozzle surface cleaning apparatus 60 is arranged in the movement path of the head supporting frame 40.

In the present embodiment, the nozzle surfaces 30C, 30M, 30Y and 30K are cleaned by moving the inkjet heads 16C, 16M, 16Y and 16K from the maintenance position to the image recording position. Therefore, the cleaning liquid deposition device 62 is arranged on the maintenance position side of the wiping device 64.

This arrangement can be reversed. In other words, the wiping device 64 can be arranged on the maintenance position side of the cleaning liquid deposition device 62. In this case, the nozzle surfaces 30C, 30M, 30Y and 30K are cleaned by moving the inkjet heads 16C, 16M, 16Y and 16K from the image recording position to the maintenance position.

Composition of Cleaning Liquid Deposition Device

Figure 5:
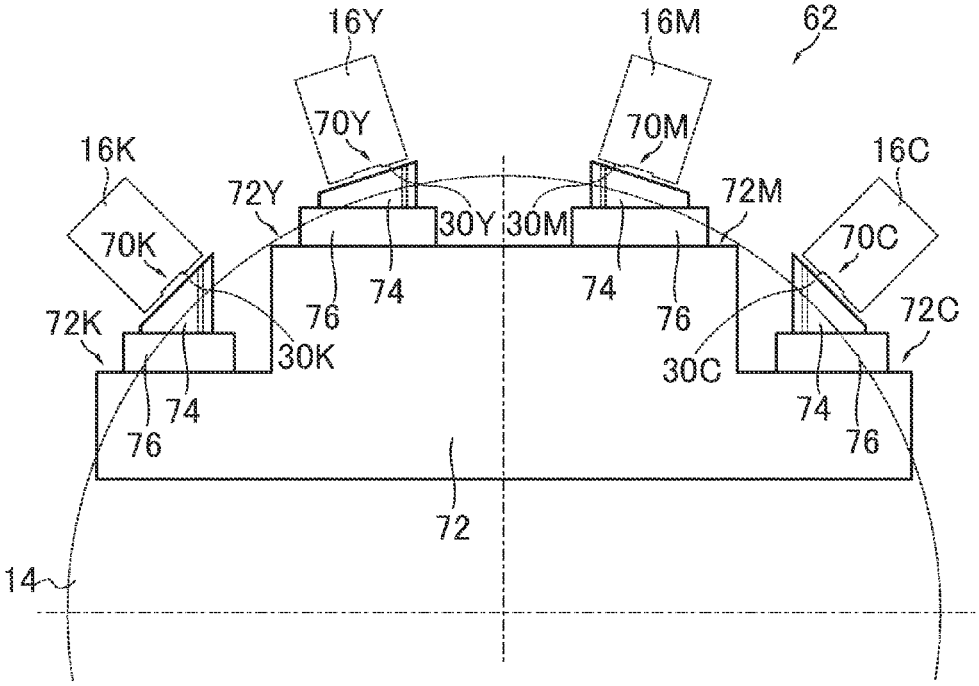
FIG. 5 is a side view diagram showing a cleaning liquid deposition device viewed from the maintenance position side.

FIG. 5 is a side view diagram showing the cleaning liquid deposition device 62 viewed from the maintenance position side.

The cleaning liquid deposition device 62 is disposed to the inner side of the waste liquid tray 54, which is arranged in the moisturizing unit 50 (see FIG. 2). The cleaning liquid deposition device 62 is constituted of cleaning liquid deposition units 70C, 70M, 70Y and 70K which are arranged correspondingly to the inkjet heads 16C, 16M, 16Y and 16K, and a cleaning liquid deposition device main body 72, on which the cleaning liquid deposition units 70C, 70M, 70Y and 70K are mounted.

<Composition of Cleaning Liquid Deposition Device Main Body>

The cleaning liquid deposition device main body 72 is horizontally arranged so as to be raisable and lowerable by an elevator device (not shown). Cleaning liquid deposition unit attachment sections 72C, 72M, 72Y and 72K are formed in the upper surface portion of the cleaning liquid deposition device main body 72. The cleaning liquid deposition units 70C, 70M, 70Y and 70K are fixed to the cleaning liquid deposition unit attachment sections 72C, 72M, 72Y and 72K formed on the cleaning liquid deposition device main body 72, by bolts, or the like, and are thereby installed in prescribed positions. By installing the cleaning liquid deposition units 70C, 70M, 70Y and 70K on the cleaning liquid deposition device main body 72, the cleaning liquid deposition units 70C, 70M, 70Y and 70K are arranged over the movement path of the corresponding inkjet heads 16C, 16M, 16Y and 16K.

<Composition of Cleaning Liquid Deposition Unit>

Next, the composition of the cleaning liquid deposition units 70C, 70M, 70Y and 70K is described.

The cleaning liquid deposition units 70C, 70M, 70Y and 70K each have the same basic composition and therefore the composition of a cleaning liquid deposition unit 70 is described here.

Figure 6:
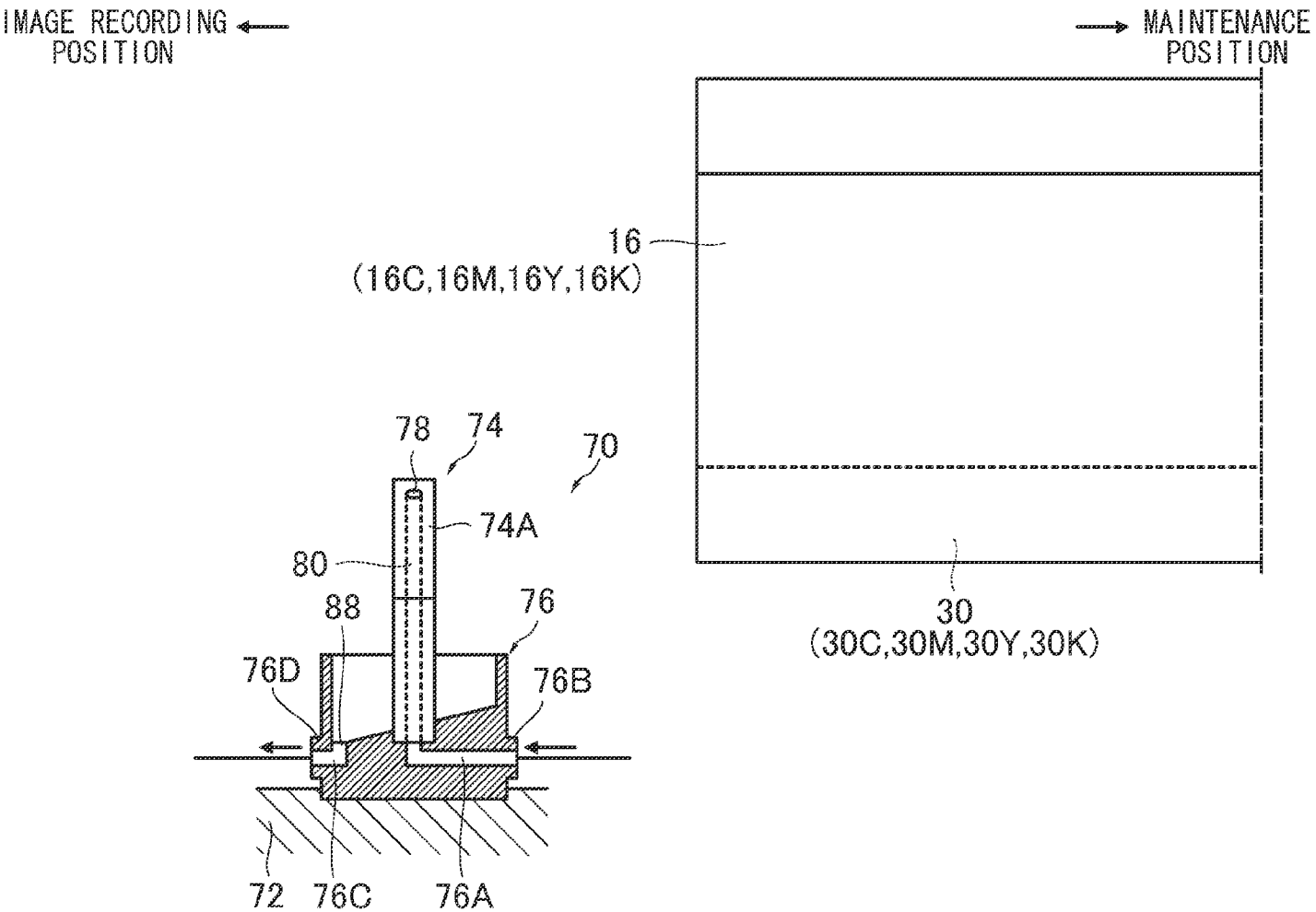
FIG. 6 is a front view diagram of a cleaning liquid deposition unit.
Figure 7:
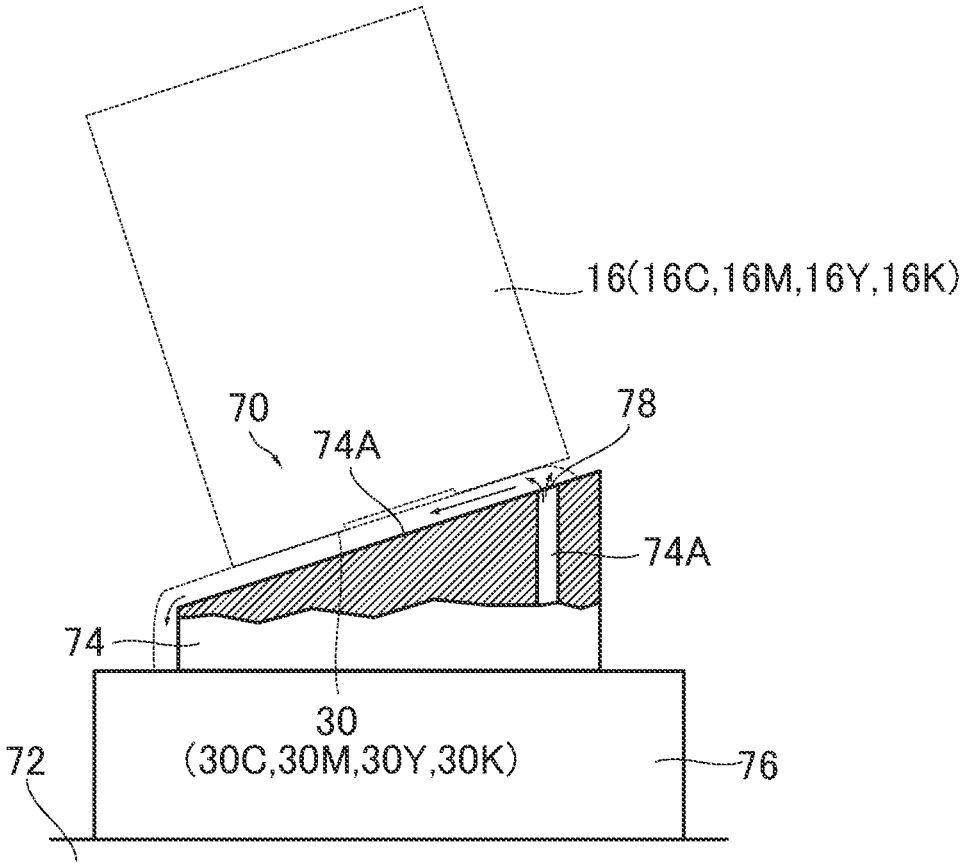
FIG. 7 is a side view diagram of the cleaning liquid deposition unit.

FIGS. 6 and 7 are a front view diagram and a side view diagram, respectively, of the cleaning liquid deposition unit 70.

As shown in FIGS. 6 and 7, the cleaning liquid deposition unit 70 includes: a cleaning liquid deposition head 74, which deposits the cleaning liquid onto the nozzle surface 30, and a cleaning liquid recovery tray 76, which recovers the cleaning liquid falling down from the nozzle surface 30.

The cleaning liquid recovery tray 76 is formed in the shape of a rectangular box of which the upper portion is open. The cleaning liquid deposition head 74 is vertically arranged inside the cleaning liquid recovery tray 76.

The cleaning liquid deposition head 74 is formed in a rectangular block shape with an inclined upper surface, and has an inclined cleaning liquid holding surface 74A on the upper portion thereof. The cleaning liquid holding surface 74A is formed at the same angle of inclination of the nozzle surface 30 of the head that is to be cleaned, and is formed to a slightly greater width than the width of the nozzle surface 30 (the width in the medium conveyance direction).

A cleaning liquid ejection port 78 is formed in the vicinity of the upper part of the cleaning liquid holding surface 74A, and the cleaning liquid is ejected from the cleaning liquid ejection port 78. The cleaning liquid which has been ejected from the cleaning liquid ejection port 78 flows down the inclined cleaning liquid holding surface 74A. By this means, a layer (film) of the cleaning liquid is formed on the cleaning liquid holding surface 74A. The cleaning liquid is deposited onto the nozzle surface 30 of the inkjet head 16 by bringing the nozzle surface 30 into contact with the layer of the cleaning liquid formed on the cleaning liquid holding surface 74A.

A cleaning liquid supply flow channel 80 connected to the cleaning liquid ejection port 78 is formed inside the cleaning liquid deposition head 74. The cleaning liquid supply flow channel 80 is connected to a connection flow channel 76A formed in the cleaning liquid recovery tray 76. The connection flow channel 76A is connected to a cleaning liquid supply port 76B formed in the cleaning liquid recovery tray 76. When the cleaning liquid is supplied to the cleaning liquid supply port 76B in the cleaning liquid deposition head 74, the cleaning liquid is ejected from the cleaning liquid ejection port 78.

The cleaning liquid is supplied from a cleaning liquid tank (not illustrated). A pipe (not illustrated) connected to the cleaning liquid tank is connected to the cleaning liquid supply port 76B. A cleaning liquid supply pump (not illustrated) and a valve (not illustrated) are arranged in this pipe. When the valve is opened and the cleaning liquid supply pump is driven, the cleaning liquid is supplied from the cleaning liquid tank to the cleaning liquid deposition head 74.

The cleaning liquid recovery tray 76 is formed in the shape of the rectangular box, the upper portion of which is open, as described above. The bottom face of the interior of the cleaning liquid recovery tray 76 is formed at an inclination, and a cleaning liquid outlet 88 is formed in the lower end portion of the bottom face in the direction of inclination. The cleaning liquid outlet 88 is connected to a cleaning liquid recovery port 76D through a cleaning liquid recovery flow channel 76C. The cleaning liquid outlet 76D is connected to the waste liquid tank 58 through a pipe (not shown). The cleaning liquid ejected from the cleaning liquid ejection port 78 of the cleaning liquid deposition head 74 falls down the cleaning liquid holding surface 74A, and is recovered into the cleaning liquid recovery tray 76 and then recovered to the waste liquid tank 58 through a pipe (not shown).

The cleaning liquid deposition device 62 is configured as described above.

The operation of the cleaning liquid deposition device 62 is controlled by a controller, which is not illustrated. The controller controls the cleaning liquid deposition operation by controlling the driving of the elevator apparatus, pump, valve, and the like.

Cleaning liquid having a main component of diethylene monobutyl ether, for example, is used as the cleaning liquid. By depositing the cleaning liquid of this type to the nozzle surface 30, it is possible to readily dissolve and remove solid attached matter originating from the ink which has adhered to the nozzle surface 30.

<Action of Cleaning Liquid Deposition Device>

Next, a cleaning liquid deposition operation by the cleaning liquid deposition device 62 according to the present embodiment having the composition described above is explained.

The cleaning liquid deposition device 62 deposits the cleaning liquid onto the nozzle surfaces 30 (30C, 30M, 30Y, 30K) of the inkjet heads 16 (16C, 16M, 16Y, 16K) while the inkjet heads 16 (16C, 16M, 16Y, 16K) move from the maintenance position to the image recording position. More specifically, the cleaning liquid is deposited as follows.

The cleaning liquid deposition device 62 positions the cleaning liquid deposition device main body 72 at a predetermined operating position and deposits the cleaning liquid to the nozzle surface 30. When cleaning is not being performed, the cleaning liquid deposition device main body 72 is disposed in a prescribed standby position. The cleaning liquid deposition device main body 72 is raised by a predetermined amount from the standby position to the operating position only during cleaning.

When the cleaning liquid deposition device main body 72 is moved to the operating position, the cleaning liquid deposition units 70 (70C, 70M, 70Y, 70K) are set in prescribed cleaning liquid deposition positions. Thereby, it is possible to deposit the cleaning liquid onto the nozzle surfaces 30 (30C, 30M, 30Y, 30K) of the inkjet heads 16 (16C, 16M, 16Y, 16K), by means of the cleaning liquid deposition heads 74 arranged in the cleaning liquid deposition units 70 (70C, 70M, 70Y, 70K). More specifically, when the cleaning liquid deposition units 70 are set in the cleaning liquid deposition positions, the cleaning liquid deposition units 70 are set in the positions where the cleaning liquid which has flowed over the cleaning liquid holding surfaces 74A of the cleaning liquid deposition heads 74 makes contact with the nozzle surfaces 30 (i.e., the positions where the gaps between the cleaning liquid holding surfaces 74A and the nozzle surfaces 30 are in a prescribed range).

The controller drives the cleaning liquid supply pump in accordance with the timing at which the inkjet heads 16 arrive at the cleaning liquid deposition heads 74 of the cleaning liquid deposition units 70, so as to supply the cleaning liquid to the cleaning liquid deposition units 70. Thereby, the cleaning liquid flows out at a prescribed flow rate from the cleaning liquid ejection ports 78 of the cleaning liquid deposition heads 74 arranged in the respective cleaning liquid deposition units 70. The cleaning liquid which has flowed out from the cleaning liquid ejection ports 78 flows down over the cleaning liquid holding surfaces 74A. Thus, a layer (film) of the cleaning liquid is formed on the cleaning liquid holding surfaces 74A.

When the inkjet heads 16 moving toward the image recording position pass the respective cleaning liquid deposition heads 74, the nozzle surfaces 30 thereof make contact with the layer of cleaning liquid formed on the cleaning liquid holding surfaces 74A of the cleaning liquid deposition heads 74. Thereby, the cleaning liquid is deposited onto the nozzle surfaces 30.

Composition of Wiping Device

Figure 8:
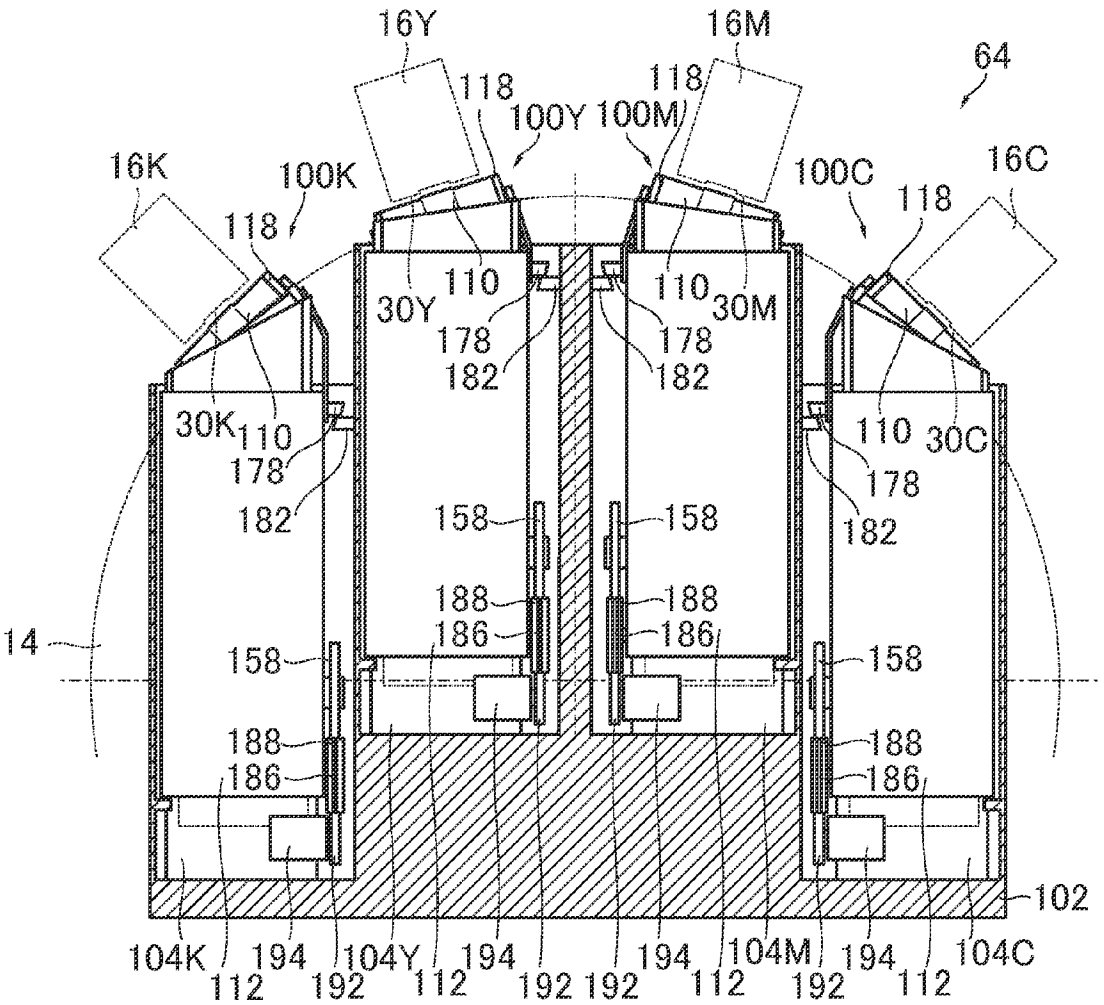
FIG. 8 is a side view diagram showing a wiping device viewed from the maintenance position side.

FIG. 8 is a side view diagram showing the wiping device 64 viewed from the maintenance position side.

As shown in FIG. 8, the wiping device 64 includes: wiping units 100C, 100M, 100Y and 100K, which are arranged correspondingly to the inkjet heads 16C, 16M, 16Y and 16K; and a wiping device main body 102, in which the wiping units 100C, 100M, 100Y and 100K are set.

<Composition of Wiping Device Main Body>

The wiping device main body 102 is horizontally arranged so as to be raisable and lowerable by an elevator device (not shown). The wiping device main body 102 is formed in a box shape having an open upper end portion, and wiping unit installation sections 104C, 104M, 104Y and 104K for installing the wiping units 100C, 100M, 100Y and 100K are arranged inside wiping device main body 102.

The wiping unit installation sections 104C, 104M, 104Y and 104K are respectively formed as spaces which can accommodate the wiping units 100C, 100M, 100Y and 100K, and the upper portions thereof are open. The wiping units 100C, 100M, 100Y and 100K are set in the respective wiping unit installation sections 104C, 104M, 104Y and 104K by being inserted vertically downward through the upper openings of the wiping unit installation sections 104C, 104M, 104Y and 104K.

A lock mechanism (not shown) is arranged on each of the wiping unit installation sections 104C, 104M, 104Y and 104K, in such a manner that the installed wiping units 100C, 100M, 100Y and 100K can be locked. The lock mechanisms are, for example, composed so as to automatically operate when the wiping units 100C, 100M, 100Y and 100K are inserted into the wiping unit installation sections 104C, 104M, 104Y and 104K.

<Composition of Wiping Unit>

Next, the composition of the wiping units 100C, 100M, 100Y and 100K is described.

The wiping units 100C, 100M, 100Y and 100K all have the same basic composition and therefore the composition is described here with respect to one wiping unit 100. The same applies to the wiping unit installation sections 104C, 104M, 104Y and 104K, and here one wiping unit installation section 104 is described.

Figure 9:
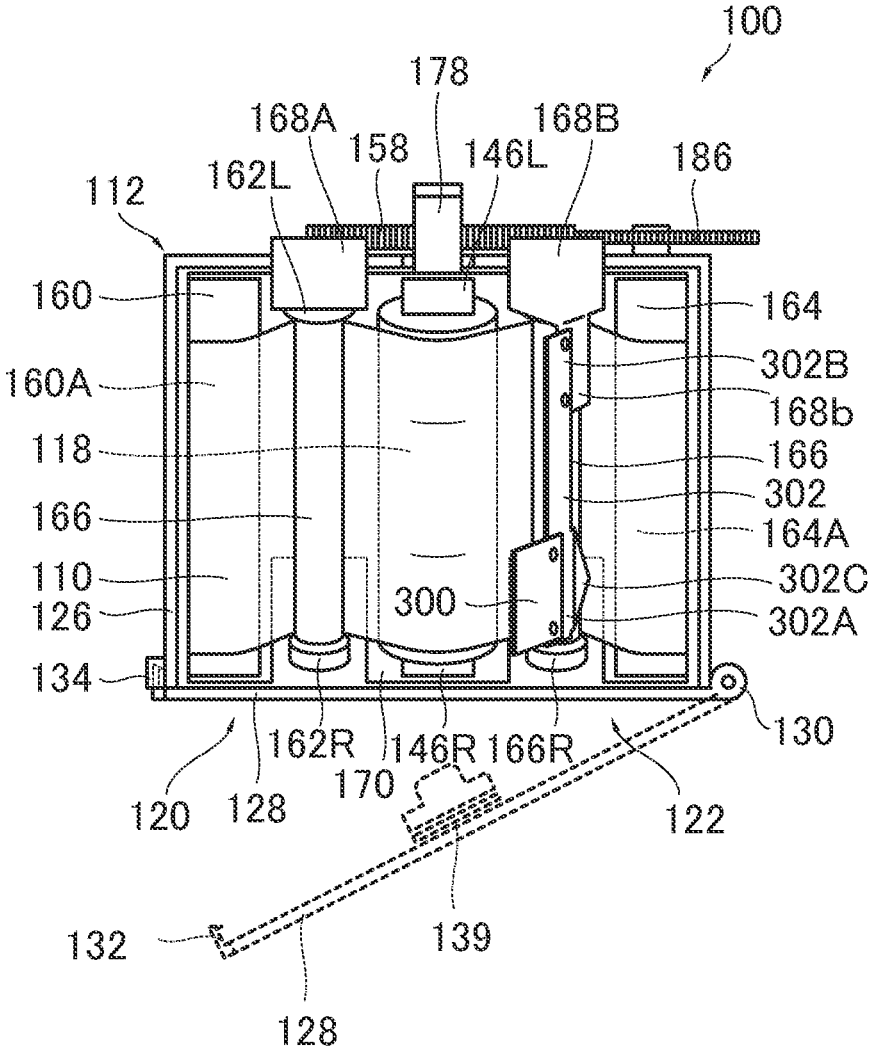
FIG. 9 is a plan diagram of a wiping unit.
Figure 10:
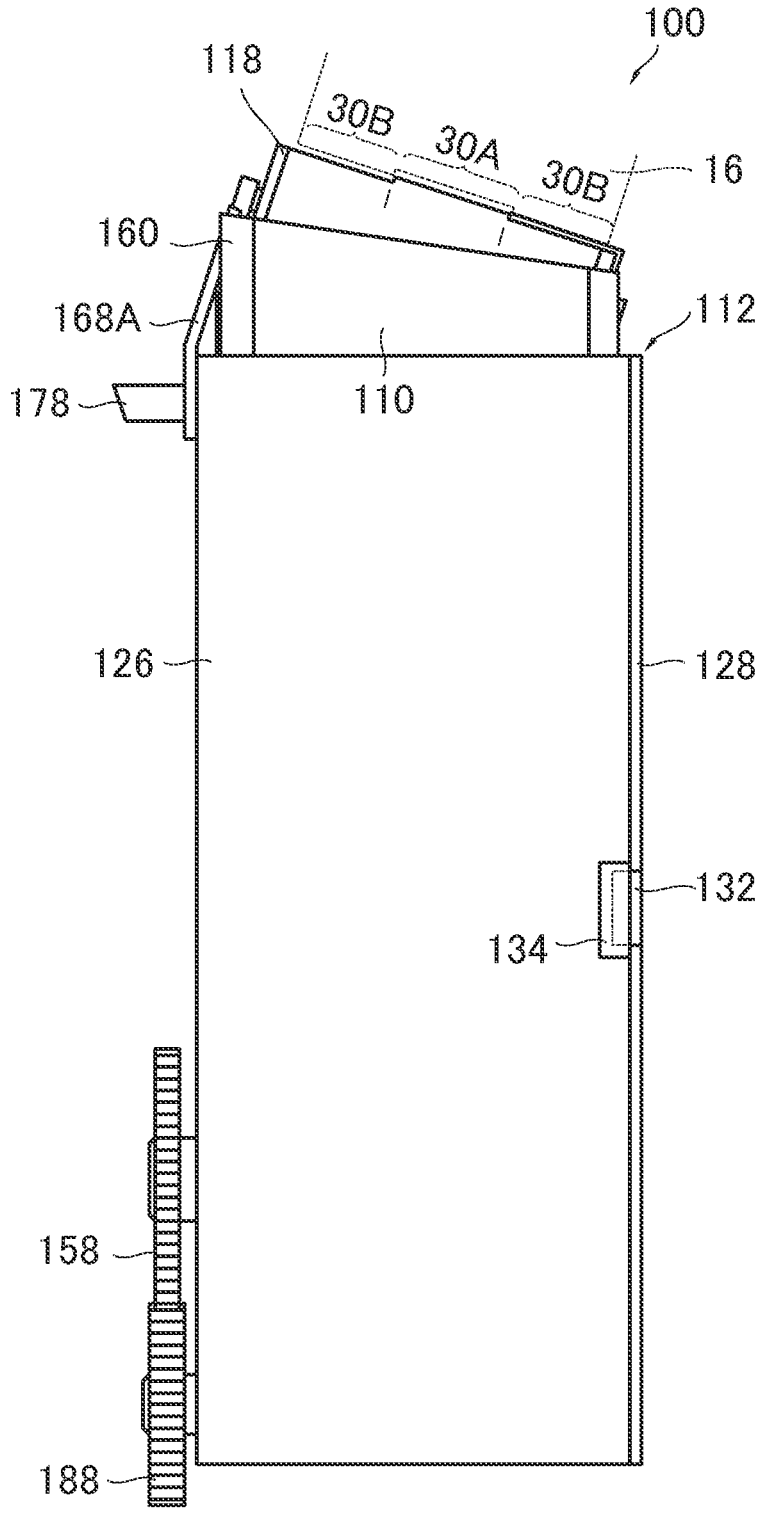
FIG. 10 is a side view diagram showing the wiping unit viewed from the image recording position side.
Figure 11:
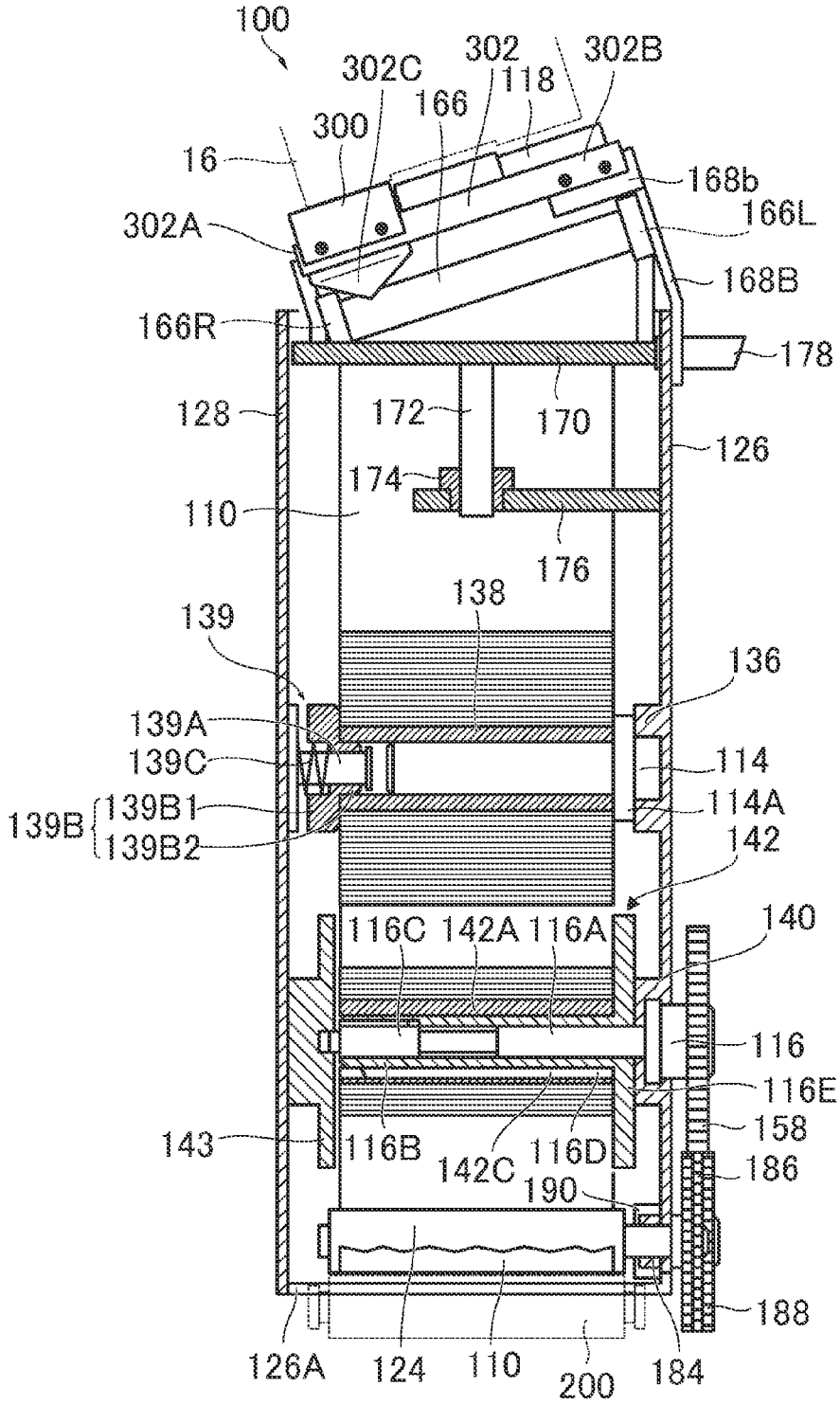
FIG. 11 is a partial cross-sectional side view diagram of the wiping unit.
Figure 12:
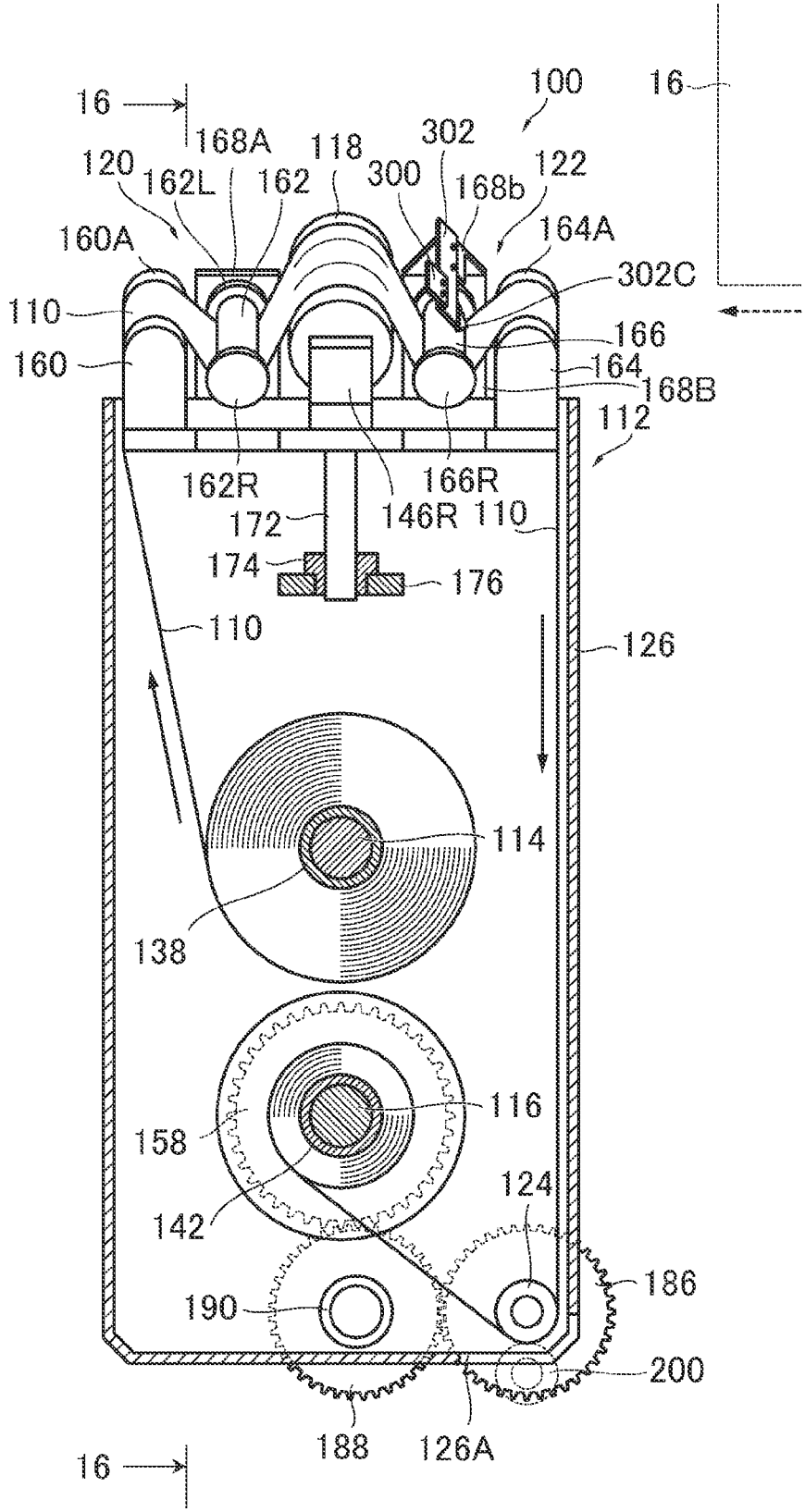
FIG. 12 is a partial cross-sectional front view diagram of the wiping unit.
Figure 13:
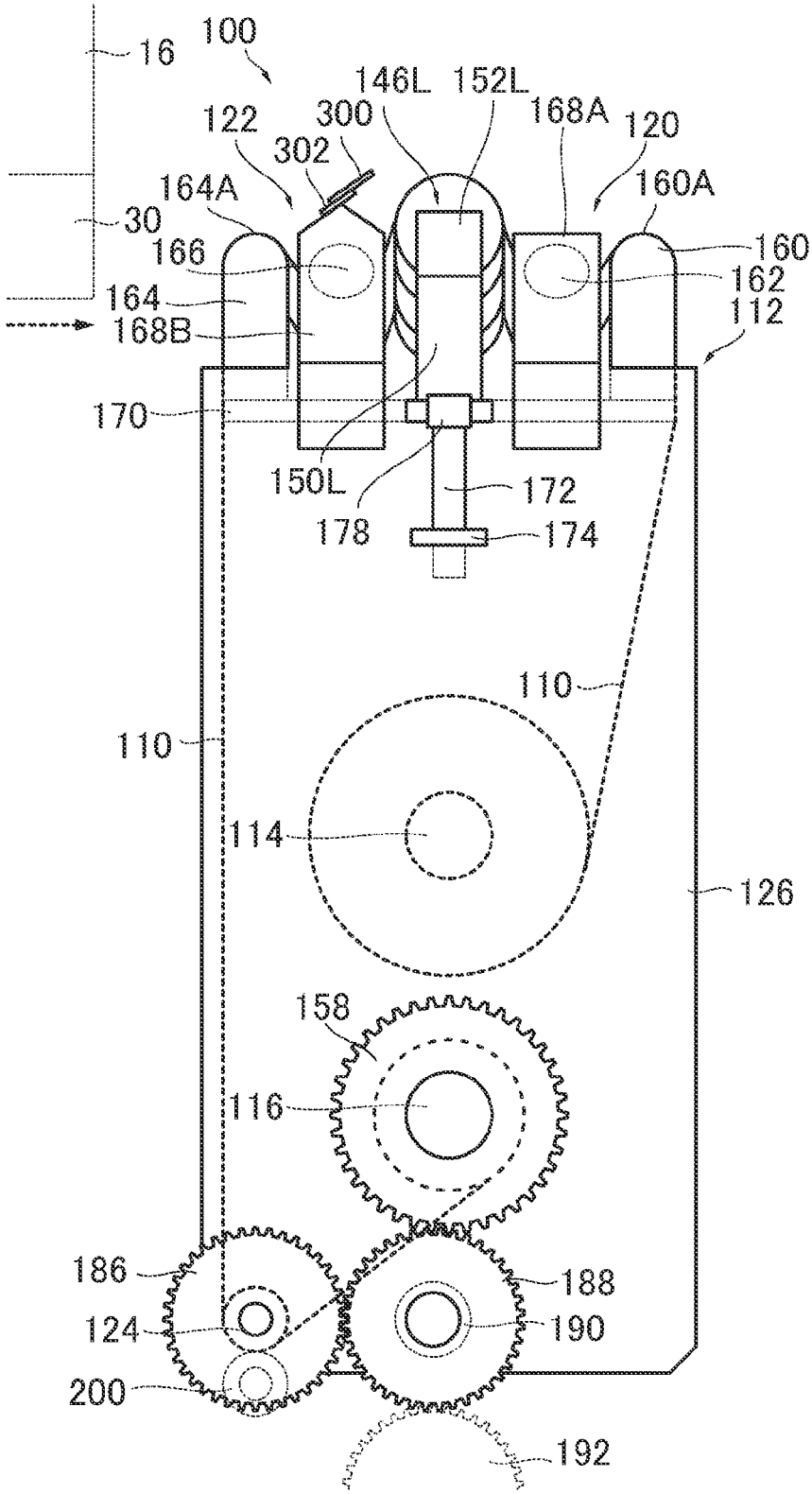
FIG. 13 is a rear view diagram of the wiping unit.

FIG. 9 is a plan diagram of the wiping unit 100, FIG. 10 is a side view diagram of the wiping unit 100 viewed from the image recording position side, FIG. 11 is an partial cross-sectional side view of the wiping unit 100, FIG. 12 is a partial cross-sectional front view of the wiping unit 100, and FIG. 13 is a rear view of the wiping unit 100.

As shown in FIGS. 9 to 13, the wiping unit 100 has a wiping web 110 formed in a band shape, which is wrapped about a pressing roller 118 obliquely disposed, and the wiping unit 100 wipes and cleans the nozzle surface of the inkjet head by pressing the wiping web 110 wrapped about the pressing roller 118, against the nozzle surface of the inkjet head.

The wiping unit 100 includes: a case 112; a pay-out spindle 114, which pays out the wiping web 110 formed in a band shape; a take-up spindle 116, which takes up the wiping web 110; a front-stage guide 120, which guides the wiping web 110 paid out from the pay-out spindle 114 so as to be wrapped about the pressing roller 118; a rear-stage guide 122, which guides the wiping web 110 having been wrapped about the pressing roller 118 so as to be taken up onto the take-up spindle 116; a grid roller (drive roller) 124, which conveys the wiping web 110; and a blade 300, which wipes a lower end region in the inclination direction of the nozzle surface 30 before wiping the nozzle surface 30 by the wiping web 110.

The case 112 is constituted of a case main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The pay-out spindle 114 has a cylindrical shape, and the base end portion thereof is fixed (supported in cantilever fashion) on a spindle bearing section 136 arranged on the case main body 126, with the pay-out spindle 114 installed horizontally inside the case main body 126. A pay-out core 138 is detachably installed on the pay-out spindle 114. The pay-out spindle 114 is formed to be slightly shorter than the length of the pay-out core 138. Therefore, when the pay-out core 138 is installed, the pay-out spindle 114 recedes in the inner circumference portion of the pay-out core 138.

The pay-out core 138 has a cylindrical shape. The wiping web 110 formed in a band shape is wound in the form of a roll about the pay-out core 138.

The pay-out core 138 is installed on the pay-out spindle 114 by inserting the pay-out spindle 114 into the inner circumferential portion of the pay-out core 138 and thereby fitting the pay-out core 138 onto the pay-out spindle 114. The pay-out core 138 that has been installed on the pay-out spindle 114 rotates about the pay-out spindle 114 and is rotatably supported.

Here, as shown in FIG. 11, a pay-out core pressing block 139 is arranged in the lid 128 of the case 112 so as to correspond to the installation position of the pay-out spindle 114. When the lid 128 is closed, the pay-out core pressing block 139 presses the end face of the pay-out core 138 installed on the pay-out spindle 114, in the axial direction thereof, thereby applying friction to the pay-out core 138.

The pay-out core pressing block 139 includes: an axle section 139A, a pressing section 139B, which is slidably arranged on the axle section 139A; and a spring 139C, which impels the pressing section 139B in the axial direction.

The axle section 139A has a round bar shape, and is installed perpendicularly on the inner surface of the lid 128. The axle section 139A is arranged so as to be positioned coaxially with the pay-out spindle 114, when the lid 128 is closed.

The pressing section 139B includes a boss 139B1 and a flange section 139B2. The boss 139B1 has a cylindrical shape, and the outer circumference thereof is formed to have substantially the same diameter as the inner diameter of the pay-out core 138 and so as to be insertable in the inner circumference portion of the pay-out core 138. Furthermore, the inner diameter of the boss 139B1 is formed to have substantially the same diameter as the outer diameter of the axle section 139A, and is slidable along the axle section 139A. The flange section 139B2 is formed integrally with the base end portion of the boss 139B1 and is formed so as to extend in the outer radial direction. The base end portion of the flange section 139B2 is formed with an enlarged inner diameter, and the spring 139C is accommodated in the inner circumference portion of this enlarged flange 139B2. The pressing section 139B is impelled toward the front end direction of the axle section 139A by this spring 139C.

A flange section is formed in the front end of the axle section 139A and detachment of the pressing section 139B is prevented by this flange section.

In the pay-out core pressing block 139, which is composed in this way, when the lid 128 of the case 112 is closed, the boss 139B1 of the pressing section 139B fits into the inner circumference portion of the pay-out core 138, and furthermore the flange section 139B2 abuts against the end face of the pay-out core 138 and presses the pay-out core 138 in the axial direction by the force of the spring 139C. Thereby, the pay-out core 138 is disposed and pressed between the pay-out core pressing block 139 and the flange 114A, and friction is applied when the core 138 rotates.

The wiping web 110 uses, for example, a knitted or woven sheet made of ultra-fine fibers of PET (polyethylene terephthalate), PE (polyethylene), NY (nylon), or the like, and is formed in a flexible band shape having a width corresponding to the width (the width in the direction perpendicular to the nozzle row) of the nozzle surface of the head being wiped.

The take-up spindle 116 is disposed so that the axis thereof is horizontal, at a position below the pay-out spindle 114. More specifically, the take-up spindle 116 is arranged below and parallel with the pay-out spindle 114.

As shown in FIG. 11, the take-up spindle 116 includes: a main shaft 116A; a slipping shaft 116B, which is arranged rotatably in a circumferential direction about the main shaft 116A; and a torque limiter 116C, which couples the main shaft 116A and the slipping shaft 116B, and is composed in such a manner that the slipping shaft 116B slides with respect to the main shaft 116A if a load (torque) over a threshold is applied.

The main shaft 116A has a round rod shape, and the vicinity of the base end portion thereof is rotatably supported on a bearing section 140, which is arranged in the case main body 126.

The slipping shaft 116B has a cylindrical shape, and is arranged rotatably in the circumferential direction about the outer circumference portion of the main shaft 116A.

The torque limiter 116C is arranged in the inner circumference portion of the front end of the slipping shaft 116B, and couples together the main shaft 116A and the slipping shaft 116B. The torque limiter 116C includes an input side rotating body (not illustrated) and an output side rotating body (not illustrated) arranged coaxially with the input side rotating body, and when a load (torque) over the threshold is applied to the output side rotating body with respect to the input side rotating body, the torque limiter 116C slides between the input side rotating body and the output side rotating body. The input side rotating body of the torque limiter 116C is connected to the main shaft 116A (for example, through a key and key groove, or a boss and boss hole, or by fixing in an integrated fashion so as to transmit rotation), and the output side rotating body is connected to the slipping shaft 116B (for example, through a key and key groove, or a boss and boss hole, or by fixing in an integrated fashion so as to transmit rotation), whereby the main shaft 116A and the slipping shaft 116B are coupled so as to enable transmission of rotation therebetween. Thus, a function is achieved whereby the slipping shaft 116B slides with respect to the main shaft 116A, when a torque over the threshold is applied to the slipping shaft 116B.

In the take-up spindle 116 having the composition described above, if a load (torque) applied to the slipping shaft 116B is within a prescribed range, then no slipping occurs and the slipping shaft 116B rotates in unison with the main spindle 116A. On the other hand, if a load (torque) applied to the slipping shaft 116B exceeds the prescribed range, then slipping occurs between the slipping shaft 116B and the main shaft 116A, and it is possible to prevent an undue load being applied to the main shaft 116A.

A take-up core 142 which takes up the wiping web 110 paid out by the pay-out core 138 is installed on the take-up spindle 116.

The composition of the take-up core 142 is substantially the same as the composition of the pay-out core 138. More specifically, the take-up core 142 has a cylindrical shape.

The leading end of the wiping web 110 wound up on the pay-out core 138 is fixed to the take-up core 142.

The take-up core 142 is installed on the take-up spindle 116 by fitting the take-up spindle 116 into the inner circumference portion 142A of the take-up core 142.

Here, as shown in FIG. 11, the take-up core 142 has a key groove 142C formed in the inner circumference portion thereof. On the other hand, a key 116D which engages with the key groove 142C is formed in the outer circumference of the take-up spindle 116 (the outer circumference of the slipping shaft 116B). When installing the take-up core 142, the key 116D formed on the take-up spindle 116 is fitted into the key groove 142C formed in the take-up core 142. Thereby, the take-up core 142 is installed in such a manner that the rotation of the take-up spindle 116 can be transmitted to the take-up core 142.

Furthermore, as shown in FIG. 11, a guide plate 143 is arranged on the inner side of the lid 128 of the case 112 so as to correspond to the installation position of the take-up spindle 116. The guide plate 143 has a circular disk shape of a diameter corresponding to the take-up diameter of the wiping web 110, and is arranged at the front end of the take-up spindle 116 when the lid 128 is closed.

Furthermore, as shown in FIG. 11, a flange 116E of substantially the same diameter as the guide plate 143 is formed on the base end portion of the take-up spindle 116. The take-up core 142 is installed on the take-up spindle 116 and is disposed between the flange 116E and the guide plate 143 when the lid 128 of the case 112 is closed. The wiping web 110 taken up onto the take-up core 142 is wound about the take-up core 142 while both edges of the wiping web 110 are guided by the flange 116E and the guide plate 143.

The main shaft 116A of the take-up spindle 116 is arranged in such a manner that the base end portion thereof projects the outer side of the case main body 126, and a take-up spindle drive gear 158 is fixed to this projecting base end portion. The take-up spindle 116 (main shaft 116A) is rotated by driving and rotating the take-up spindle drive gear 158. The drive mechanism of the take-up spindle 116 is as described below.

The pressing roller 118 is disposed above the pay-out spindle 114 (in the present embodiment, the pressing roller 118, the pay-out spindle 114 and the take-up spindle 116 are disposed on the same straight line), and is arranged at a prescribed angular inclination with respect to the horizontal plane. In other words, the pressing roller 118 is disposed in accordance with the angular inclination of the nozzle surface 30 of the inkjet head 16 that is to be wiped (i.e., the axis of the pressing roller 118 is parallel with the nozzle surface) in order to press the wiping web 110 against the nozzle surface 30 of the inkjet head 16.

Figure 14:
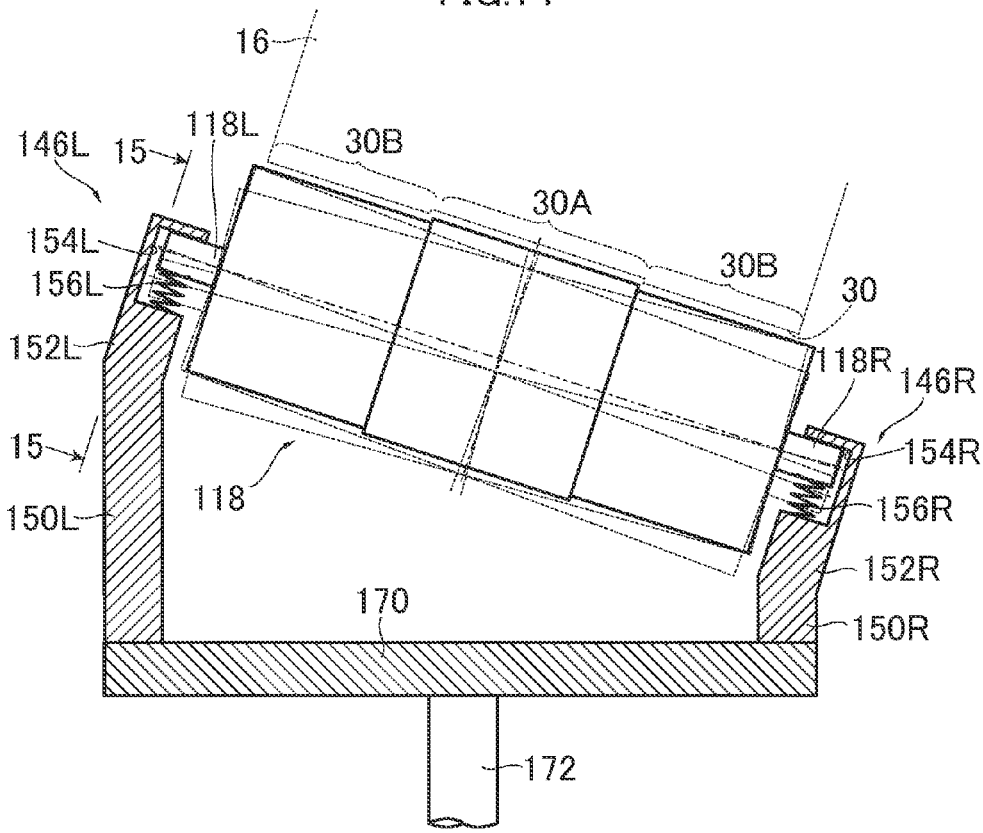
FIG. 14 is a partial cross-sectional front view diagram showing the composition of a bearing section which supports an axle section of a pressing roller.

The pressing roller 118 is formed in such a manner that the central portion thereof has an enlarged diameter in accordance with the cross-sectional shape of the nozzle surface 30 of the inkjet head 16 which is the object of cleaning (see FIG. 14). In the inkjet head 16 in the present embodiment, the central portion of the nozzle surface 30 (i.e., the nozzle forming region 30A) is formed so as to be withdrawn in the recessed shape, and therefore the central portion of the pressing roller 118 is formed so as to project (having a larger diameter than other portions) in accordance with the nozzle surface 30 which is formed in the recessed shape. More specifically, the region (the region which abuts during a wiping operation) corresponding to the nozzle forming region 30A which is withdrawn in the recessed shape is formed so as to project (expand) in accordance with the amount of withdrawal. By this means, it is possible to press the wiping web 110 appropriately against the nozzle forming region 30A which is formed in the withdrawn recessed shape.

The pressing roller 118 is provided with axle portions 118L and 118R, which project on either end portion thereof, and the axle portions 118L and 118R are supported by a pair of axle supporting sections 146L and 146R in a rotatable and swingable fashion.

Figure 15:
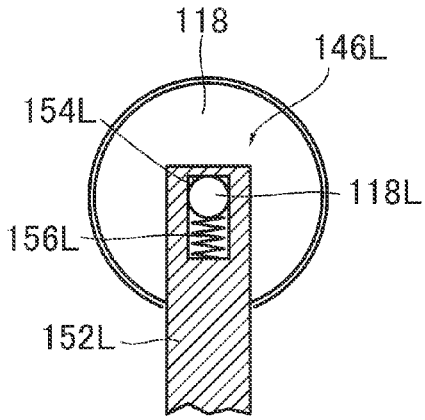
FIG. 15 is a cross-sectional view along line 15-15 in FIG. 14.

FIG. 14 is a partial cross-sectional front view diagram showing the composition of the axle supporting sections which support the axle sections 118L and 118R of the pressing roller 118, and FIG. 15 is a cross-sectional diagram along line 15-15 in FIG. 14.

As shown in FIG. 14, the axle supporting sections 146L and the 146R are arranged on an elevator stage 170, which is horizontally disposed. The axle supporting sections 146L and 146R are constituted of pillar sections 150L and 150R, which are vertically erected on the elevator stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to the diameter of each of the axle sections 118L and 118R of the pressing roller 118, and the lengthwise direction thereof is perpendicular to the nozzle surface of the inkjet head that is to be cleaned (see FIG. 15). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the inkjet head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upward by the springs 156L and 156R. By this means, it is possible to cause the circumferential surface of the pressing roller 118 to make close contact with the nozzle surface, by following the nozzle surface of the line head that is to be cleaned.

The front-stage guide 120 is constituted of a first front-stage guide 160 and a second front-stage guide 162, and the wiping web 110 paid out from the pay-out spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been paid out from the pay-out spindle 114 is changed to a direction substantially perpendicular to the axis of the pressing roller 118 from the direction perpendicular to the axis of the pay-out spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof. The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 16:
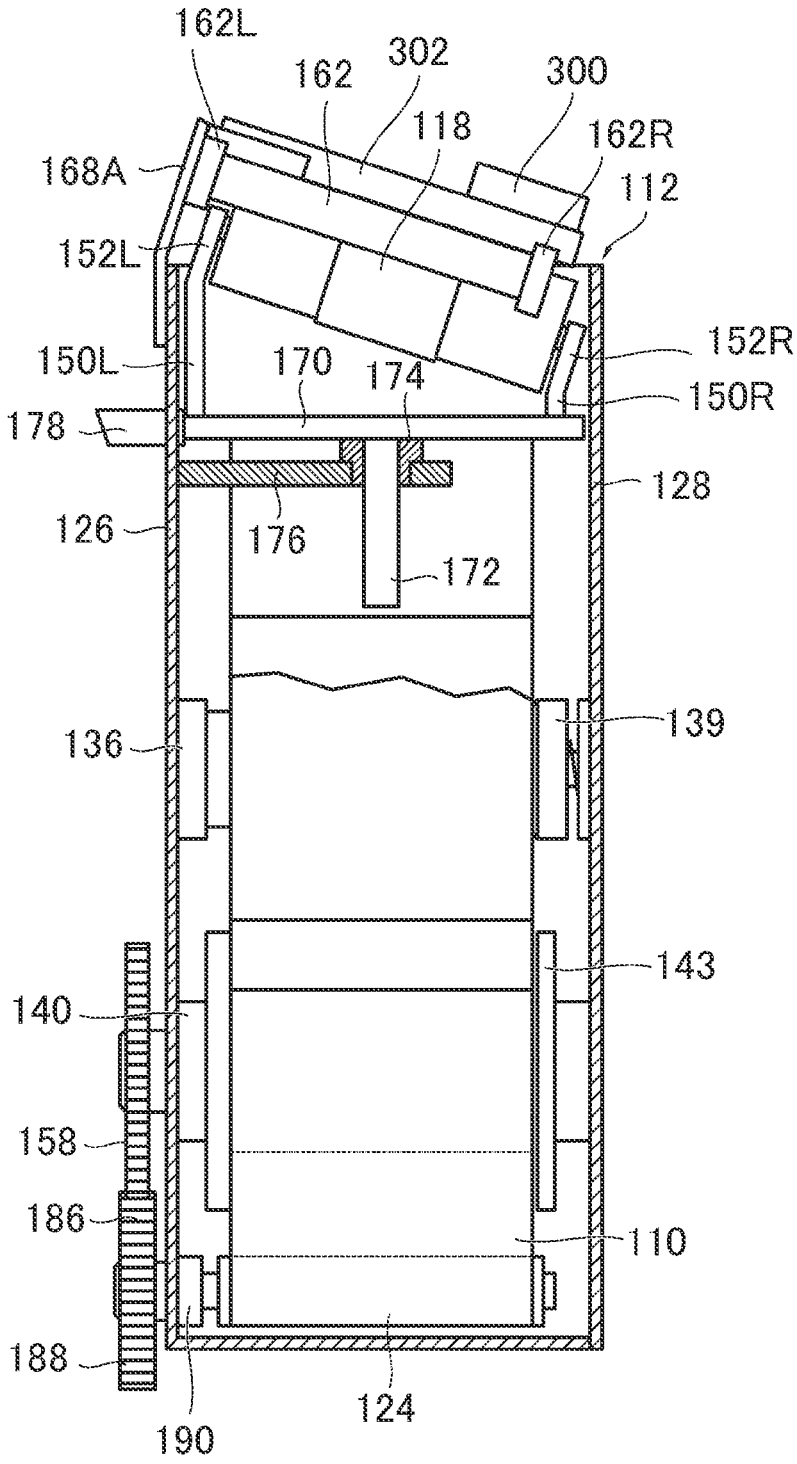
FIG. 16 is a cross-sectional view along line 16-16 in FIG. 12.

The second front-stage guide 162 is supported at only one end thereof on a bracket 168A, and the second front-stage guide 162 is disposed at a prescribed angular inclination. As shown in FIGS. 13 and 16, the bracket 168A is formed in a plate shape with a bent top end, and the base end portion of the bracket 168A is fixed to the upper end portion of the rear face of the case main body 126. The bracket 168A is arranged so as to project perpendicularly upward from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

As described above, the first front-stage guide 160, the pressing roller 118 and the first rear-stage guide 164 are arranged on the elevator stage 170. The elevator stage 170 can be raised and lowered in the direction vertical to the horizontal plane.

As shown in FIG. 11, a guide shaft 172 is connected integrally with the elevator stage 170. The guide shaft 172 vertically extends downward from the lower face of the elevator stage 170 and is fitted into a guide bush 174 disposed inside the case main body 126. The guide bush 174 is fixed to the inner wall face of the case main body 126 through a supporting member 176, and guides the guide shaft 172 vertically.

Figure 17A:
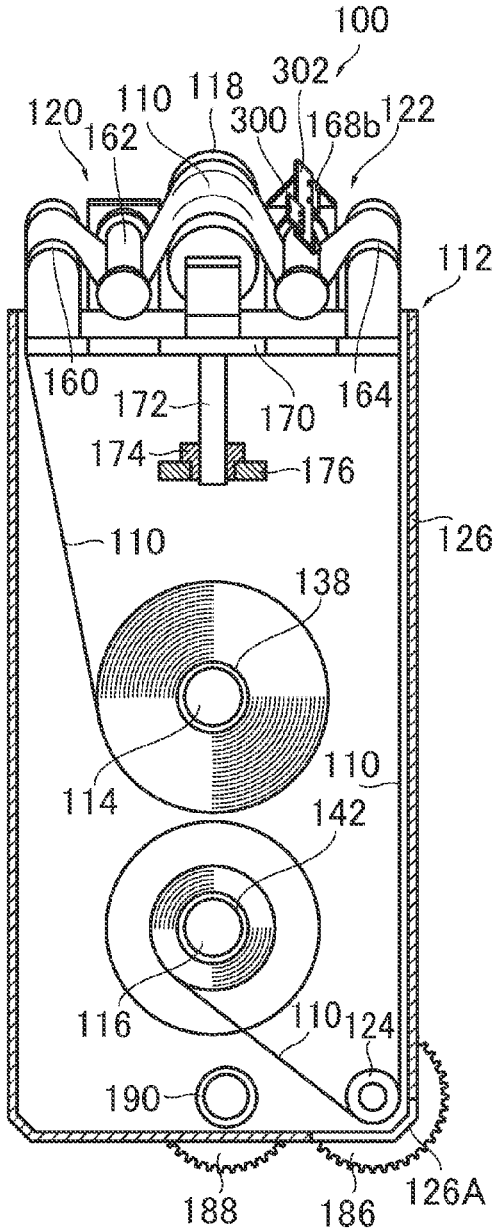
FIG. 17A is an illustrative diagram showing a state of a wiping web in the wiping unit during use.
Figure 17B:
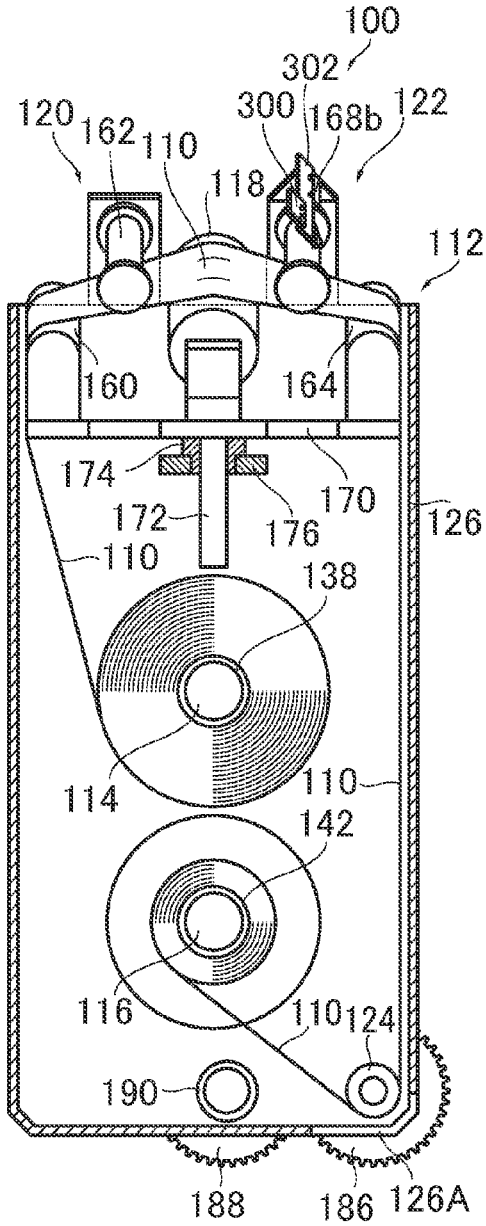
FIG. 17B is an illustrative diagram showing a state of the wiping web during replacement.

In this way, the elevator stage 170 on which the first front-stage guide 160, the pressing roller 118 and the first rear-stage guide 164 are disposed is arranged raisable and lower ably in the direction vertical to the horizontal plane. Therefore, as shown in FIGS. 17A and 17B, by raising and lowering the elevator stage 170, it is possible to cause the first front-stage guide 160, the pressing roller 118 and the first rear-stage guide 164 to advance and retreat with respect to the second front-stage guide 162 and the second rear-stage guide 166, which are fixedly arranged. By this means, it is possible to simply replace the wiping web 110.

More specifically, by lowering the elevator stage 170, as shown in FIG. 17B, the first front-side guide 160, the pressing roller 118 and the first rear-stage guide 164 can be retracted downward with respect to the second front-stage guide 162 and the second rear-stage guide 166, and therefore a large space between same can be ensured. Thereby, it is possible to simply carry out the task of wrapping the wiping web 110 about the respective sections. Furthermore, the wiping web 110 can be simply wrapped about the respective sections by wrapping the wiping web 110 about the first front-stage guide 160, the pressing roller 118 and the first rear-stage guide 164, with the first front-stage guide 160, the pressing roller 118 and the first rear-stage guide 164 in the downwardly retracted state, and then raising the elevator stage 170. In other words, if the wiping web 110 is wrapped about the first front-stage guide 160, the pressing roller 118 and the first rear-stage guide 164, whereupon the elevator stage 170 is raised, as shown in FIG. 17A, then the wiping web 110 is automatically wrapped about the second front-stage guide 162 and the second rear-stage guide 166.

In this way, by making the first front-stage guide 160, the pressing roller 118 and the first rear-stage guide 164 capable of advancing and retracting with respect to the second front-stage guide 162 and the second rear-stage guide 166, it is possible to simply carry out the task of replacing the wiping web 110.

The first front-stage guide 160, the pressing roller 118 and the first rear-stage guide 164 need to be positioned in the prescribed use position (the position in FIG. 17A) when being used, and the first front-stage guide 160, the pressing roller 118 and the first rear-stage guide 164 are moved to the use position in coordination with the installation of the wiping unit 100 on the wiping device main body 102.

This coordinated mechanism will now be described. As shown in FIGS. 11 and 13, an elevator lever (engagement section) 178 is arranged on the elevator stage 170, on which the first front-stage guide 160, the pressing roller 118 and the first rear-stage guide 164 are arranged. The elevator lever 178 is arranged so as to project from the rear face of the case main body 126 through a cutaway portion 180 formed on the rear face of the case main body 126. The elevator stage 170 is raised and lowered by sliding the elevator lever 178.

Figure 18A:
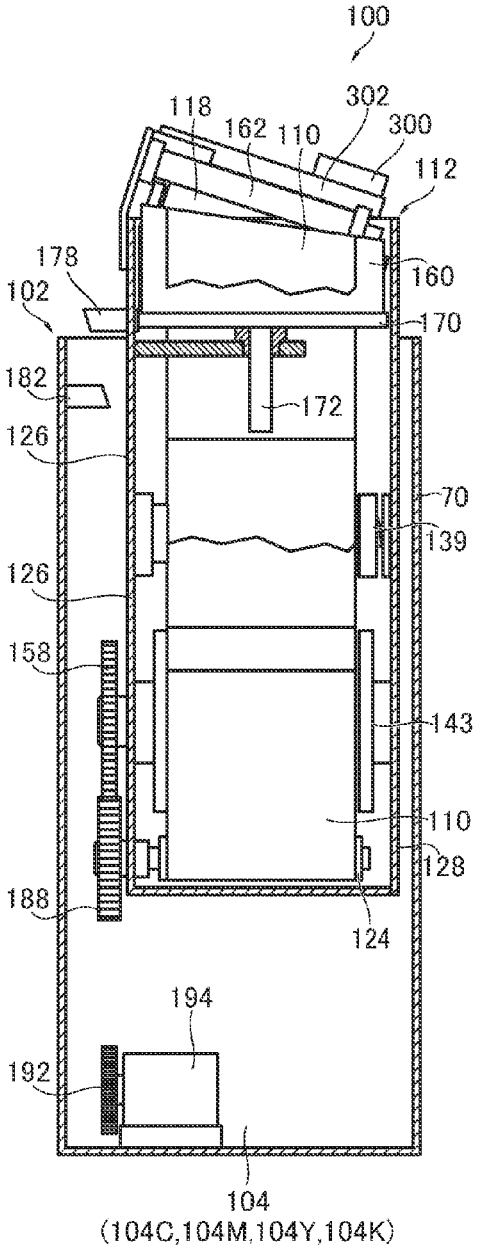
FIGS. 18A and 18B are illustrative diagrams of a coordination mechanism for raising and lowering an elevator table.
Figure 18B:
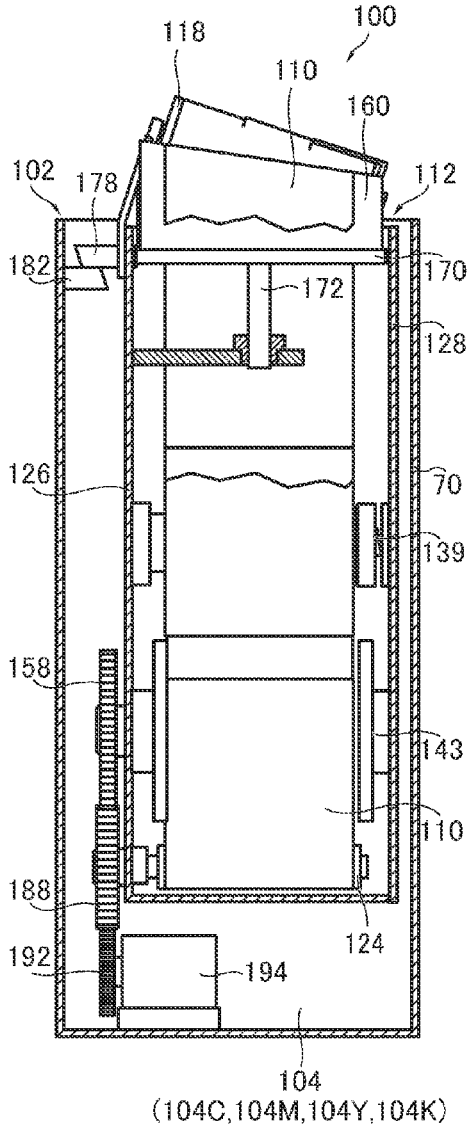

On the other hand, as shown in FIGS. 18A and 18B, a pin (engaged section) 182 is projectingly arranged on the inner side of the installation section 104 (104C, 104M, 104Y and 104K) of the wiping device main body 102 in which the wiping unit 100 is set. The pin 182 is arranged so as to engage with the elevator lever 178 arranged on the wiping unit 100 when the wiping unit 100 is installed on the installation section 104.

According to the composition described above, as shown in FIGS. 18A and 18B, when the wiping unit 100 is inserted into the installation section 104 of the wiping device main body 102, the elevator lever 178 engages with the pin 182 and is forcibly raised up to a prescribed position. Thereby, the first front-stage guide 160, the pressing roller 118 and the first rear-stage guide 164 are registered in the prescribed use position.

In this way, the first front-stage guide 160, the pressing roller 118 and the first rear-stage guide 164 are moved to the use position in coordination with the installation of the wiping unit 100 on the wiping device main body 102.

The grid roller 124 is disposed in the vicinity of the base face of the case main body 126, in a position below the first rear-stage guide 164. The grid roller 124 drives and guides the wiping web 110 of which the travel direction has been changed to the direction perpendicular to the take-up spindle 116 by the first rear-stage guide 164, so that the wiping web 110 is taken up onto the take-up spindle 116.

The grid roller 124 is arranged in parallel with the take-up spindle 116 (namely in parallel with the horizontal plane), and the vicinity of the base end portion thereof is rotatably supported on a bearing section 184, which is arranged on the case main body 126. Furthermore, the grid roller 124 is arranged in such a manner that the base end portion of the rotating shaft thereof projects to the outer side of the case main body 126, and a grid roller drive gear 186 is fixed to this projecting base end portion of the rotating shaft. The grid roller 124 is rotated by driving the grid roller drive gear 186 to rotate.

Here, the drive mechanism of the wiping unit 100 including the grid roller 124 is described.

In the wiping unit 100 according to the present embodiment, by driving the take-up spindle 116 to rotate while also driving the grid roller 124 to rotate, the wiping web 110 is caused to travel from the pay-out spindle 114 toward the take-up spindle 116.

As described above, the take-up spindle drive gear 158 is fixed to the take-up spindle 116 (the main spindle 116A which constitutes the take-up spindle 116). On the other hand, the grid roller drive gear 186 is fixed to the grid roller 124. As shown in FIG. 13, the take-up spindle drive gear 158 and the grid roller drive gear 186 mesh with a rotation transmission gear 188.

The rotating shaft of the rotation transmission gear 188 is horizontally arranged and is rotatably supported on a bearing section 190 arranged on the case main body 126. The take-up spindle drive gear 158 and the grid roller drive gear 186 are both caused to rotate in the same direction by driving the rotation transmission gear 188. Due to the rotation of the take-up spindle drive gear 158 and the grid roller drive gear 186, the take-up spindle 116 and the grid roller 124 rotate.

Here, in the wiping device 64 according to the present embodiment, the gears of different diameters (the gears having different numbers of teeth) are used for the take-up spindle drive gear 158 and the grid roller drive gear 186, and the take-up spindle 116 and the grid roller 124 are set so as to rotate at different velocities. More specifically, in the wiping device 64 according to present embodiment, in order to be able to convey the wiping web 110 without any slackness, the rotational velocity of the take-up spindle 116 and the rotational velocity of the grid roller 124 are set in such a manner that the velocity at which the wiping web 110 is taken up onto the take-up core 142 is faster than the velocity at which the wiping web 110 is conveyed by the grid roller 124. Thereby, it is possible to stably take up the wiping web 110 without any slackness.

More specifically, the rotational velocity of the take-up spindle 116 and the rotational velocity of the grid roller 124 are set in such a manner that the circumferential velocity V1 of the take-up core 142 installed on the take-up spindle 116 is greater than the circumferential velocity V2 of the grid roller 124 (V1>V2), and the gear ratio of the take-up spindle drive gear 158 and the grid roller drive gear 186 is set on the basis of these velocities.

The rotational velocities actually set are determined by finding optimal velocities through experimentation, and the like. More specifically, if there is too large a difference between these velocities, then this can cause abrasion, breakdown, or the like, and therefore the rotational velocities are set by finding optimal values on the basis of experimentation, or the like.

Even if there is a difference between the take-up speed and the conveyance speed in this way, since the slipping mechanism (based on the torque limiter 116C) is arranged in the take-up spindle 116 of the wiping device 64 according to the present embodiment, then it is possible to drive the take-up spindle 116, the grid roller 124, the motor 194, and the like, without placing excessive load thereon.

The rotation transmission gear 188, which causes the take-up spindle drive gear 158 and the grid roller drive gear 186 to rotate, meshes with a drive gear 192 arranged inside the installation section 104 when the wiping unit 100 is installed in the wiping unit installation section 104 of the wiping device main body 102.

The drive gear 192 is fixed to the output shaft of the motor 194 and when the wiping unit 100 is installed in the wiping unit installation section 104, the drive gear 192 is disposed in a position so as to mesh with the rotational transmission gear 188.

The motor 194 is constituted of a pulse motor, for example, and is installed on the base portion of the wiping unit installation section 104. The driving of the motor 194 is controlled by the controller (not shown).

The drive mechanism of the wiping unit 100 is composed as described above.

In this way, by installing the wiping unit 100 on the wiping unit installation section 104 of the wiping device main body 102, the rotation transmission gear 188 arranged in the case 112 of the wiping unit 100 meshes with the drive gear 192 arranged in the wiping unit installation section 104 (see FIGS. 18A and 18B). When the motor 194 is driven in this state, then the drive gear 192 fixed to the output shaft of the motor 194 rotates and this rotation is transmitted to the rotation transmission gear 188 and causes the rotation transmission gear 188 to rotate.

When the rotation transmission gear 188 rotates, this rotation of the rotation transmission gear 188 is transmitted to the take-up spindle drive gear 158 and the grid roller drive gear 186, and hence the take-up spindle drive gear 158 and the grid roller drive gear 186 rotate. Thereby, the take-up spindle 116 and the grid roller 124 rotate. Due to this rotation of the take-up spindle 116 and the grid roller 124, the wiping web 110 is paid out from the pay-out core 138 installed on the pay-out spindle 114 and is wound up onto the take-up core 142 installed on the take-up spindle 116 through a prescribed path of travel.

As described above, when the wiping unit 100 is installed on the wiping unit installation section 104, the rotation transmission gear 188 meshes with the drive gear 192, and the take-up spindle 116 and the grid roller 124 can be driven.

Figure 19:
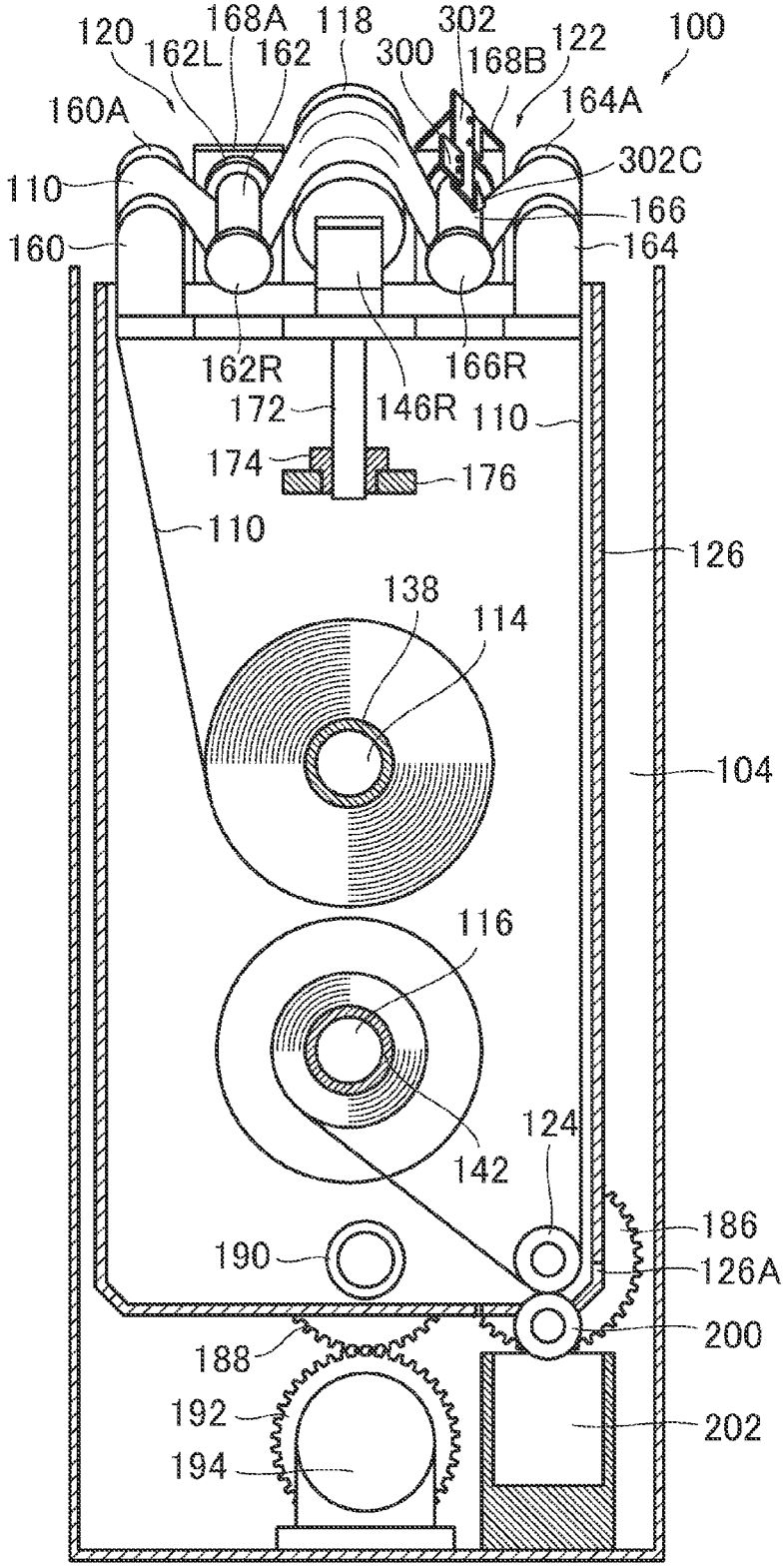
FIG. 19 is a partial cross-sectional front view diagram showing a state where the wiping unit has been installed in an installation section.
Figure 20:
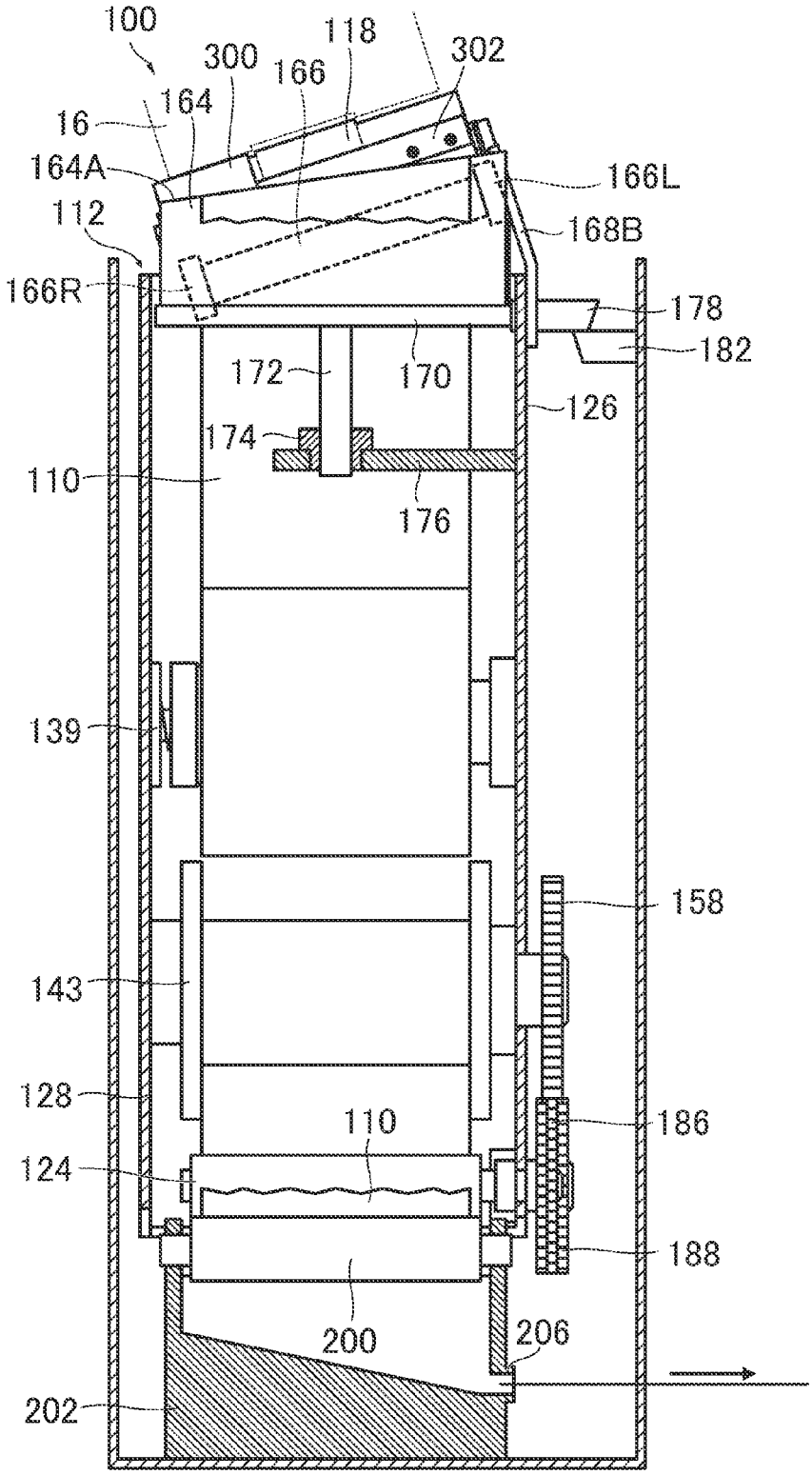
FIG. 20 is a partial cross-sectional side view diagram showing the state where the wiping unit has been installed in the installation section.

On the other hand, when the wiping unit 100 is installed on the wiping unit installation section 104, as shown in FIGS. 19 and 20, a nip roller 200 arranged in the wiping unit installation section 104 is pressed against the outer circumference portion of the grip roller 124 through an opening 126A formed in the bottom portion of the case main body 126.

The nip roller 200 has substantially the same width as the grid roller 124 and the outer circumference portion of the nip roller 200 is covered with an elastic body made of rubber, or the like. The nip roller 200 is installed horizontally on in a waste liquid receptacle 202 which is disposed in the wiping unit installation section 104.

The waste liquid receptacle 202 has a rectangular box shape of which the upper portion is open, and bearing sections (not shown) for supporting the nip roller 200 are arranged on the upper edge portions thereof. The nip roller 200 is supported by the bearing sections so as to be rotatable in the waste liquid receptacle 202.

The bottom face of the interior of the waste liquid receptacle 202 is formed with an inclination, and a waste liquid outlet 206 is formed in the lower end portion of the bottom face in the direction of inclination. The waste liquid outlet 206 is connected to the waste liquid tank 58 through a pipe (not shown).

When the wiping unit 100 on which the wiping web 110 has been installed is fitted into the wiping unit installation section 104, then the wiping web 110 wound about the grid roller 124 is nipped between the nip roller 200 and the grid roller 124. The wiping web 110 which is nipped between the nip roller 200 and the grid roller 124 is sent toward the take-up core 142 by driving the grid roller 124 to rotate in this state.

Here, the wiping web 110 nipped between the nip roller 200 and the grid roller 124 is the wiping web 110 that has been wiped the nozzle surface, and therefore this wiping web 110 has absorbed the cleaning liquid, and the like. The liquid absorbed by the wiping web 110 is removed from the wiping web 110 and recovered in the waste liquid receptacle 202 when the wiping web 110 passes between the grid roller 124 and the nip roller 200.

Thereby, the nip roller 200 and the grid roller 124 function as the conveyance device for the wiping web 110, and also function as the device for removing liquid (waste liquid) which has been absorbed by the wiping web 110. Thus, it is possible to prevent the waste liquid from dripping down off the wiping web 110 which is taken up on the take-up core 142 and soiling the peripheral area or causing breakdown of the apparatus.

The blade 300 wipes the lower end region in the inclination direction of the nozzle surface 30 before the nozzle surface 30 is wiped by the wiping web 110. In the inkjet recording apparatus according to the present embodiment, since each inkjet head 16 is arranged around the image recording drum 14, the nozzle surface 30 is inclined. When the cleaning liquid is deposited to the nozzle surface 30 inclined in this manner, the cleaning liquid flows down the nozzle surface 30 due to its own weight and pools in the lower end region in the inclination direction of the nozzle surface 30. When the nozzle surface 30 is wiped by the wiping web 110 in this state, an absorption capacity of the wiping web 110 can be exceeded at the lower end region and wiping can be insufficient. Hence, in the wiping device 64 according to the present embodiment, the lower end region of the nozzle surface 30 is wiped by the blade 300 to remove excess cleaning liquid and the like as waste liquid, before the wiping web 110 wipes the nozzle surface 30.

The blade 300 is formed of a flexible material (silicone rubber, EPDM, NBR, urethane, or the like is favorably used which is unaffected by the cleaning liquid used) into a thin plate shape that has a width enough to be capable of wiping the lower end region in the inclination direction of the nozzle surface 30 (for example, the width enough to be capable of wiping the nozzle protecting region 30B positioned on the lower side in the inclination direction). The blade 300 is mounted to a blade support plate 302.

The blade support plate 302 is formed as a rectangular plate piece and is attached to the bracket 168B, which supports the second rear-stage guide 166.

A blade mounting portion 302A is formed on a top end portion of the blade support plate 302. The blade 300 is screwed to the blade mounting portion 302A and thereby fastened to the blade support plate 302.

On the other hand, a mounted portion 302B is formed on a base end portion of the blade support plate 302. The blade support plate 302 is fastened to the bracket 168B by screwing the mounted portion 302B to a blade support plate mounting portion 168*b* formed on the bracket 168B.

The blade support plate mounting portion 168*b* is integrally formed with the bracket 168B by bending a part of the bracket 168B formed in the rectangular shape. As a result of mounting to the blade support plate mounting portion 168*b*, the blade support plate 302 is arranged approximately parallel to the second rear-stage guide 166. Moreover, as a result of the blade support plate 302 mounted to the blade support plate mounting portion 168*b*, a sliding contact portion (a portion that wipes the nozzle surface) of the end of the blade 300 is arranged parallel to the nozzle surface 30 and perpendicular to the movement direction of the nozzle surface 30 (the longitudinal direction of the head). Furthermore, the blade 300 is arranged so that when the wiping device main body 102 is raised and the wiping web 110 is pressed against the nozzle surface 30, the blade 300 abuts the lower end region in the inclination direction of the nozzle surface 30 in an inclined state. More specifically, the blade 300 is arranged slightly slanted toward the pressing roller 118 so as to abut the nozzle surface 30 in the inclined state.

Figure 21A:
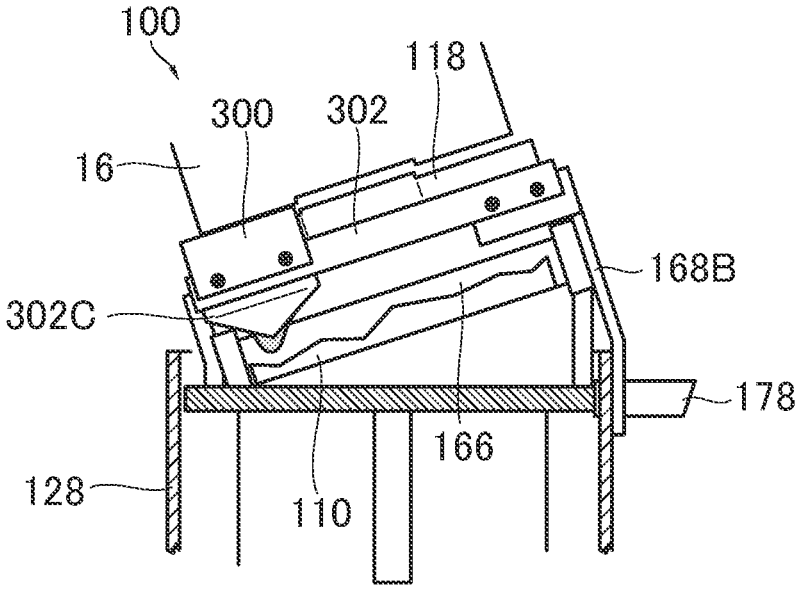
FIG. 21A is an explanatory diagram of a dripping state of a waste liquid when a drip guiding part is arranged.
Figure 21B:
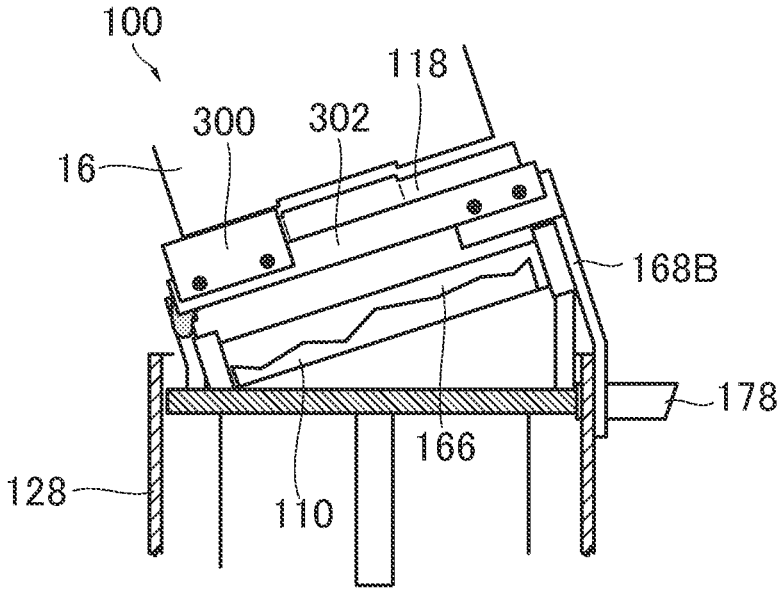
FIG. 21B is an explanatory diagram of a dripping state of a waste liquid when no drip guiding part is arranged.

A drip guiding part 302C is integrally formed at a lower part of the end of the blade support plate 302. The drip guiding part 302C is formed as a plate piece with a triangular tip portion, and guides the waste liquid scraped off of the nozzle surface 30 by the blade 300 to the triangular tip portion. Then, the waste liquid is caused to drip onto the wiping web 110 from the triangular tip portion. More specifically, while the waste liquid which is scraped off of the nozzle surface 30 by the blade 300 flows from the blade 300 and down along the blade support plate 302 due to its own weight, the drip guiding part 302C guides the waste liquid that flows down from the blade support plate 302 due to its own weight to drip onto the wiping web 110. As shown in FIG. 21A, the blade support plate 302 in the present embodiment is provided with the drip guiding part 302C, and the drip position is corrected and the waste liquid drips onto the wiping web 110. On the other hand, if the blade support plate 302 is not provided with the drip guiding part 302C as shown in FIG. 21B, the waste liquid drips from a tip (a lower end in the inclination direction) of the blade support plate 302.

In the present embodiment, the drip guiding part 302C is formed so that the waste liquid drips onto the wiping web 110 that is wound around the second rear-stage guide 166. Therefore, the drip guiding part 302C is installed at a position approximately directly above the second rear-stage guide 166.

The position onto which the waste liquid drips is favorably further inward of the wiping web 110 (closer to the center of the wiping web 110) as possible. It is thereby possible to recover the waste liquid more reliably.

The wiping units 100 (100C, 100M, 100Y, 100K) are composed as described above.

The wiping units 100 (100C, 100M, 100Y, 100K) are composed as described above.

The wiping device 64 is composed by installing the wiping units 100C, 100M, 100Y and 100K in the wiping unit installation section 104 of the wiping device main body 102.

The operation of the wiping device 64 is controlled by the controller (not shown). The controller controls the wiping operation by the wiping device 64 by controlling the driving of the elevator device, motor 194, and the like.

<Action of Wiping Device>

Next, the action of the wiping device 64 according to the present embodiment having the above-described composition is explained.

<<Installation of Wiping Web>>

The method of installing the wiping web 110 on the wiping unit 100 is described.

The wiping web 110 is presented in a wound state in the form of a roll on the pay-out core 138, and the leading end of the wiping web 110 is fixed to the take-up core 142.

Firstly, the wiping unit 100 is taken out from the wiping device main body 102 and the lid 128 of the case 112 is opened. When the lid 128 is opened, the pay-out spindle 114 and the take-up spindle 116 are exposed, and then the pay-out core 138 is installed on the pay-out spindle 114 and the take-up core 142 is installed on the take-up spindle 116.

At this time, the pay-out core 138 and the take-up core 142 are installed while wrapping the wiping web 110 about the first front-stage guide 160, the pressing roller 118, the first rear-stage guide 164, and the grid roller 124.

More specifically, firstly, the pay-out core 138 is installed on the pay-out spindle 114. The pay-out core 138 is installed by fitting the pay-out core 138 onto the pay-out spindle 114. Thereby, the pay-out core 138 is rotatably supported about the pay-out spindle 114.

Thereupon, the wiping web 110 is paid out by a prescribed amount from the pay-out core 138, passed below the second front-stage guide 162 and the second rear-stage guide 166, and the wiping web 110 is wrapped about the upper side of the first front-stage guide 160, the pressing roller 118 and the first rear-stage guide 164. At this time, the wiping web 110 is wrapped about the first front-stage guide 160, the pressing roller 118 and the first rear-stage guide 164 while the elevator stage 170 is in the lowered state, in other words, while the first front-stage guide 160, the pressing roller 118 and the first rear-stage guide 164 are in the downwardly retracted state. Thereby, it is possible to ensure sufficient space with respect to the second front-stage guide 162 and the second front-stage guide 166, and the wiping web 110 can be easily wrapped about the first front-stage guide 160, the pressing roller 118 and the first rear-stage guide 164 by passing below the second front-stage guide 162 and the second rear-stage guide 166.

The wiping web 110 wrapped around the first front-stage guide 160, the pressing roller 118 and the first rear-stage guide 164 is further wrapped around the grid roller 124, and finally the take-up core 142 is installed on the take-up spindle 116.

The take-up core 142 is installed by fitting the take-up core 142 onto the take-up spindle 116. In this case, the key groove 142C formed in the inner circumference of the take-up core 142 is fitted onto the key 116D formed on the outer circumference of the take-up spindle 116. Thereby, the take-up core 142 is installed on the take-up spindle 116 in a state where the rotation in the circumferential direction is restricted. Accordingly, the rotation of the take-up spindle 116 can be transmitted to the take-up core 142, and the take-up core 142 can be rotated together with the take-up spindle 116.

As described above, since the torque limiter 116C is arranged on the take-up spindle 116, then slipping occurs if a load over the prescribed threshold is applied, and therefore it is possible to wind up the wiping web 110 while avoiding undue load.

By means of the foregoing steps, the installation of the wiping web 110 is completed. Thereupon, the lid 128 of the case 112 is closed.

Here, when the lid 128 is closed, the pay-out core pressing block 139 arranged inside the lid 128 abuts against the end face of the pay-out core 138 installed on the pay-out spindle 114, and presses the pay-out core 138 in the axial direction thereof. Thus, the pay-out core 138 is disposed between the pay-out core pressing block 139 and the flange 114A of the pay-out spindle 114, and thereby receives friction. Due to friction being applied to the pay-out core 138 in this way, the wiping web 110 can be caused to stably travel without slackness, even if there is a sudden change in the tension.

Furthermore, when the lid 128 is closed, the guide plate 143 arranged on the inside of the lid 128 is disposed on the front end of the take-up spindle 116. Thus, it is possible to take the wiping web 110 up onto the take-up core 142 while aligning the side end of the wiping web 110.

<<Setting in Wiping Device Main Frame>>

Thereupon, the wiping unit 100 in which the wiping web 110 has been installed is set in the wiping device main body 102.

The wiping unit 100 is set in the wiping device main body 102 by vertically inserting the wiping unit 100 into the wiping unit installation section 104 formed in the wiping device main body 102.

When the wiping unit 100 has been set in the wiping unit installation section 104, as shown in FIG. 18B, the rotation transmission gear 188 of the wiping unit 100 meshes with the drive gear 192 arranged in the wiping unit installation section 104. Thereby, the take-up spindle 116 and the grid roller 124 become drivable.

Furthermore, when the wiping unit 100 is set in the wiping unit installation section 104, the elevator lever 178 arranged on the elevator stage 170 engages with the pin 182 arranged on the wiping unit installation section 104, and the elevator stage 170 is forcibly raised up to the prescribed position. Thereby, the first front-stage guide 160, the pressing roller 118 and the first rear-stage guide 164 are registered in the prescribed use position. By registering the first front-stage guide 160, the pressing roller 118 and the first rear-stage guide 164 in the prescribed use position, the wiping web 110 becomes wrapped about the second front-stage guide 162, which is disposed between the first front-stage guide 160 and the pressing roller 118, and furthermore the wiping web 110 also becomes wrapped about the second rear-stage guide 166, which is disposed between the pressing roller 118 and the first rear-stage guide 164. Thus, the wiping web 110 is tautly wrapped about the circumferential surface of the pressing roller 118.

Moreover, when the wiping unit 100 is set in the wiping unit installation section 104, as shown in FIGS. 19 and 20, the nip roller 200 arranged on the wiping unit installation section 104 is pressed against the grid roller 124. Thereby, the wiping web 110 wrapped around the grid roller 124 is nipped between the nip roller 200 and the grid roller 124.

By means of the foregoing, the setting of the wiping unit 100 in the wiping device main body 102 is completed.

In the thus set wiping unit 100 in the wiping device main body 102, by driving the motor 194, the wiping web 110 is paid out from the pay-out spindle 114 and taken up onto the take-up spindle 116 after passing along the prescribed path of travel.

Furthermore, as shown in FIG. 8, the pressing rollers 118 of the wiping units 100C, 100M, 100Y and 100K, which correspond respectively to the nozzle surfaces 30C, 30M, 30Y and 30K of the inkjet heads 16C, 16M, 16Y and 16K disposed with their nozzle surfaces 30C, 30M, 30Y and 30K at the inclinations with respect to the horizontal plane, are positioned in parallel with the nozzle surfaces 30C, 30M, 30Y and 30K, respectively. Thus, it is possible to cause the wiping webs 110 wrapped about the respective pressing rollers 118 to make tight contact with the corresponding nozzle surfaces 30C, 30M, 30Y and 30K.

<<Wiping Operation>>

Similarly to the cleaning liquid deposition device 62, the wiping device 64 wipes and cleans the nozzle surfaces 30 (30C, 30M, 30Y, 30K) of the inkjet heads 16 (16C, 16M, 16Y, 16K) while the inkjet heads move from the maintenance position to the image recording position. More specifically, the nozzle surfaces are wiped as follows.

The wiping device 64 positions the wiping device main body 102 at a predetermined operating position and wipes the nozzle surface 30 with the wiping web 110. When cleaning is not being performed, the wiping device main body 102 is disposed in a prescribed standby position. The wiping device main body 102 is raised by a predetermined amount from the standby position to the operating position only during cleaning.

When the wiping device 64 is moved to the operating position, the nozzle surfaces 30 (30C, 30M, 30Y, 30K) of the inkjet heads 16 (16C, 16M, 16Y, 16K) can be wiped by the wiping units 100 (100C, 100M, 100Y, 100K). More specifically, when each inkjet head 16 passes the wiping unit 100, it is possible for the wiping web 110 wound about the pressing roller 118 to be pressed against the nozzle surface 30. Further, the blade 300 can be pressed against the nozzle surface 30.

When each inkjet head 16 in which the cleaning liquid has been deposited on the nozzle surface 30 by the cleaning liquid deposition device 62 passes by the wiping unit 100, the blade 300 is pressed to the lower end region in the inclination direction of the nozzle surface 30. Accordingly, excess cleaning liquid pooled at the lower end portion in the inclination direction of the nozzle surface 30 is removed.

After the nozzle surface 30 pass by the blade 300, the wiping web 110 wound around the pressing roller 118 is pressed against the nozzle surface 30. Thereby, the nozzle surface 30 is wiped by the wiping web 110.

The controller drives the motor 194 and causes the wiping web 110 to travel, in accordance with the timing at which each inkjet head 16 arrives at the wiping unit 100. Thereby, the traveling wiping web 110 can be pressed against the nozzle surface 30, and the nozzle surface 30 can be wiped by the traveling wiping web 110.

As described above, the wiping device 64 wipes the nozzle surface 30 by pressing the wiping web 110 against the nozzle surface 30. In doing so, in the wiping device 64 according to the present embodiment, the lower end region in the inclination direction of the nozzle surface 30 is wiped in advance by the blade 300, and the nozzle surface 30 is then wiped by the wiping web 110 after excess cleaning liquid pooled at the lower end region in the inclination direction of the nozzle surface 30 has been removed. Thus, the nozzle surface 30 can be wiped without remaining liquid.

Moreover, while the cleaning liquid and the like (waste liquid) scraped off of the nozzle surface 30 by the blade 300 flows from the blade 300 along the blade support plate 302 and drips off of the blade support plate 302 due to its own weight, since the drip guiding part 302C is formed at the blade support plate 302 in the wiping device 64 according to the present embodiment, the waste liquid drips down from the drip guiding part 302C. Since the wiping web 110 is arranged under the drip position of the drip guiding part 302C, the waste liquid drips onto the wiping web 110 (see FIG. 21A). Consequently, the waste liquid that is scraped off by the blade 300 can be reliably recovered without staining the surroundings.

Further, since the wiping web 110 onto which the waste liquid drips is the used wiping web 110, the nozzle surface 30 can constantly be wiped by a new wiping web 110.

The wiping web 110 that has finished wiping is wound up on the take-up core 142 as described above, but is nipped between the grid roller 124 and the nip roller 200 at the front-stage position of the take-up core 142. By this means, the absorbed liquid (cleaning liquid, ink, etc.) is removed from the wiping web 110. Hence, the waste liquid does not drip from the wiping web 110 that is wound up by the take-up core 142 to stain the inside of the apparatus. The waste liquid removed from the wiping web 110 by the nip roller 200 falls due to its own weight and is recovered in the waste liquid receptacle 202. The waste liquid recovered in the waste liquid receptacle 202 is recovered to the waste liquid tank 58 from the waste liquid outlet 206 through a pipe (not shown).

Action of Nozzle Surface Cleaning Apparatus

The nozzle surface cleaning apparatus 60 according to the present embodiment is composed as described above.

Next, a nozzle surface cleaning operation performed by the nozzle surface cleaning apparatus 60 in the present embodiment is described.

The cleaning of the nozzle surfaces is performed while the inkjet heads 16 (16C, 16M, 16Y, 16K) are moved from the maintenance position to the image recording position.

During the movement process of the inkjet heads 16 from the maintenance position to the image recording position, first, the cleaning liquid is deposited to each nozzle surface 30 (30C, 30M, 30Y, 30K) by the cleaning liquid deposition device 62 and, subsequently, the nozzle surface 30 is wiped by the wiping device 64.

When a nozzle surface cleaning instruction is input to the controller, the controller moves the cleaning liquid deposition device main body 72 of the cleaning liquid deposition device 62 to the prescribed operating position. Thereby, it becomes possible for the cleaning liquid deposition device 62 to deposit the cleaning liquid.

After the cleaning liquid deposition device 62 has been moved to the prescribed operating position, the controller causes the head supporting frame 40 to move from the maintenance position to the image recording position at a prescribed movement speed.

On the other hand, the controller also drives the cleaning liquid supply pump in accordance with the timing at which the inkjet heads 16 arrive at the cleaning liquid deposition heads 74 of the cleaning liquid deposition units 70 (70C, 70M, 70Y, 70K). Thereby, the cleaning liquid flows out at a prescribed flow rate from the cleaning liquid ejection ports 78 of the cleaning liquid deposition heads 74 arranged in the respective cleaning liquid deposition units 70. The cleaning liquid which has flowed out from the cleaning liquid ejection ports 78 flows down over the cleaning liquid holding surfaces 74A.

When the inkjet heads 16 moving toward the image recording position pass the cleaning liquid deposition heads 74, the cleaning liquid which has flowed over the cleaning liquid holding surfaces 74A of the cleaning liquid deposition heads 74 contacts the nozzle surfaces 30, and the cleaning liquid is thereby deposited on the nozzle surfaces 30.

The inkjet heads 16 having the cleaning liquid deposited to the nozzle surfaces 30 are moved in this state toward the image recording position. In passing the wiping units 100 (100C, 100M, 100Y, 100K), the nozzle surfaces 30 are cleaned by wiping.

The controller drives the motor 194 and causes the wiping web 110 to travel, in accordance with the timing at which each inkjet head 16 arrives at the wiping unit 100.

Moreover, the controller drives the elevating apparatus (not shown) to move the wiping device main body 102 to the operating position, in accordance with the timing at which each inkjet head 16 arrives at the wiping unit 100.

Thereby, the blade 300 is pressed against the lower end region in the inclination direction of the nozzle surface 30 to which the cleaning liquid has been deposited, and excess cleaning liquid pooled at the lower end region in the inclination direction of the nozzle surface 30 is removed.

After the excess cleaning liquid is removed by the blade 300 from the nozzle surface 30, the traveling wiping web 110 is pressed against the nozzle surface 30 and the entire nozzle surface 30 is wiped by the wiping web 110.

When the nozzle surface 30 has completely passed the cleaning liquid deposition unit 70, the controller halts the driving of the cleaning liquid supply pump and the supply of the cleaning liquid. Thereupon, the controller withdraws the cleaning liquid deposition device 62 the standby position.

When the nozzle surface 30 has completely passed the wiping unit 100, the controller halts the driving of the motor 194 and the travel of the wiping web 110. Thereupon, the controller withdraws the wiping device main body 102 to the standby position.

The cleaning of the nozzle surfaces 30 of the inkjet heads 16 is completed by the series of steps described above.

As described above, in the nozzle surface cleaning apparatus 60 according to the present embodiment, after the cleaning liquid is deposited on the nozzle surface 30, excess cleaning liquid is removed by the blade 300, and then the nozzle surface 30 is wiped by the wiping web 110. Thus, the nozzle surface 30 can be reliably cleaned without remaining liquid.

In doing so, since the excess cleaning liquid (waste liquid) removed by the blade 300 is guided over the wiping web 110 and dripped thereon, cleaning can be performed without staining the surroundings.

Moreover, since causing the excess cleaning liquid (waste liquid) to drip onto the wiping web 110 eliminates the need to provide a separate recovery member, a simplified configuration can be achieved.

Furthermore, by arranging the excess cleaning liquid (waste liquid) to drip onto the used wiping web 110, the nozzle surface 30 can be constantly wiped with a new wiping web 110.

While the wiping web 110 is arranged to travel in the opposite direction to the movement direction of the nozzle surface 30 in the present embodiment, the wiping web 110 can alternatively be arranged to wipe the nozzle surface 30 while traveling in the same direction as the movement direction of the nozzle surface 30. Moreover, while the waste liquid is dripped onto the used wiping web 110 in the present embodiment, the waste liquid can alternatively be arranged to drip on an unused wiping web 110.

Other Embodiments of Wiping Unit

While the embodiment described above is configured to have the waste liquid (excess cleaning liquid) scraped off by the blade 300 drip onto the wiping web 110 and recovered, a configuration for recovering the waste liquid scraped off by the blade 300 is not limited thereto.

Figure 22:
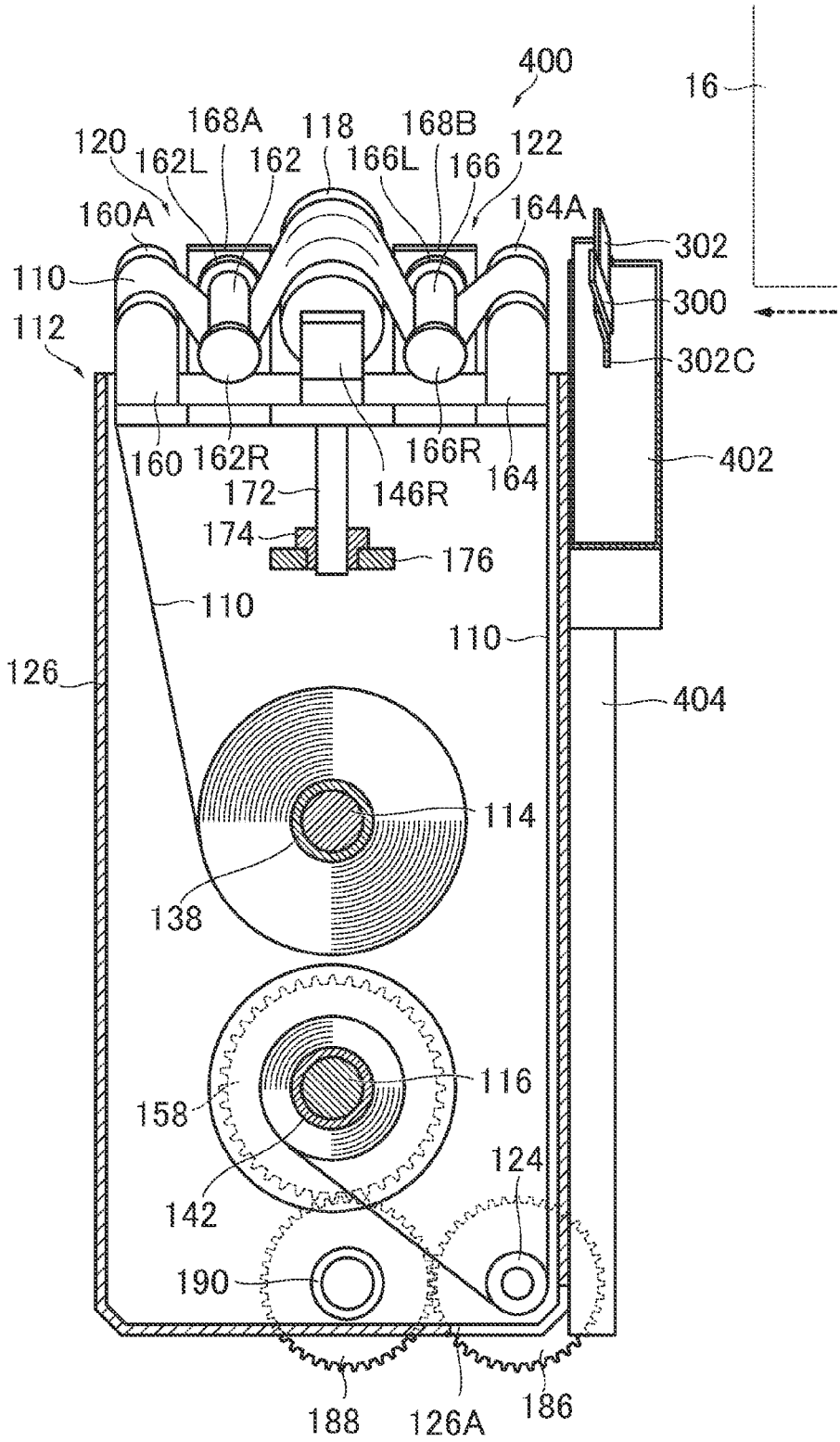
FIG. 22 is a front partial cross-sectional view showing another embodiment of the wiping unit.
Figure 23:
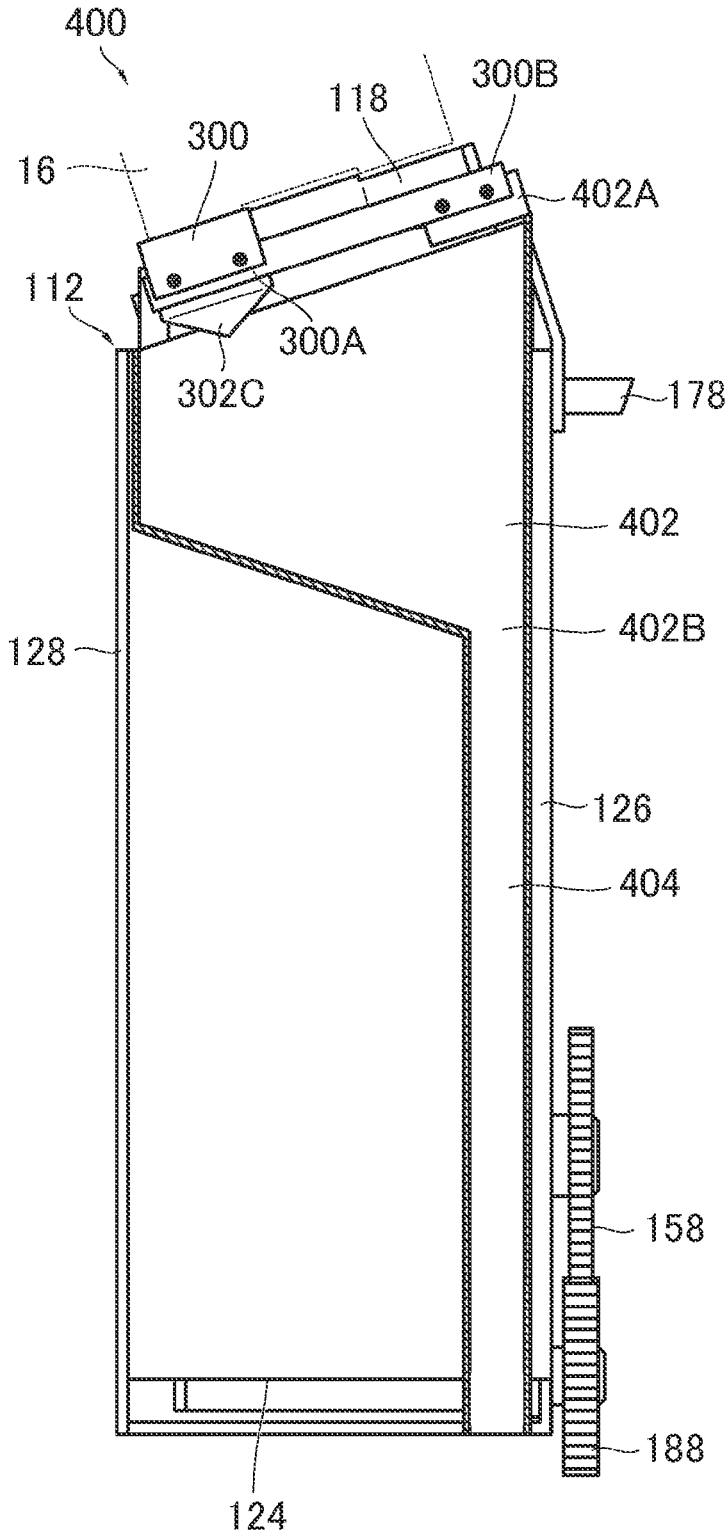
FIG. 23 is a side partial cross-sectional view showing the wiping unit in FIG. 22.

FIGS. 22 and 23 are a front partial cross-sectional view and a side portion cross-sectional view, respectively, showing another embodiment of the wiping unit.

As shown in FIGS. 22 and 23, a wiping unit 400 in the present embodiment recovers the waste liquid scraped off by the blade 300 with a receptor 402.

The receptor 402 is mounted to a side portion (a side portion on the maintenance position side) of the case main body 126. The receptor 402 is formed in a flat box shape with a small thickness (a width in the lateral direction in FIG. 22), and a width in the depth direction (the front-rear direction in FIG. 22: the direction perpendicular to the travel direction of the wiping web 110) is formed to approximately the same width as the width of the case main body 126. An upper portion of the receptor 402 is formed opened, and a bottom portion of the receptor 402 is formed inclined.

A blade support plate mounting part 402A is integrally formed on the upper portion of a rear face of the receptor 402, and the blade support plate 302 is mounted to the blade support plate mounting part 402A. Configurations of the blade support plate 302 and the blade 300 are the same as those arranged in the wiping unit 100 in the embodiment described above.

By mounting the blade support plate 302 to the blade support plate mounting part 402A, the blade 300 is arranged approximately directly above the receptor 402 of which the upper portion is opened. A sliding contact portion at the tip of the blade 300 is arranged parallel to the nozzle surface 30 and perpendicular to the travel direction of the nozzle surface 30. Furthermore, the blade 300 is arranged so that when the wiping device main body 102 is raised and the wiping web 110 is pressed against the nozzle surface 30, the blade 300 abuts the lower end region in the inclination direction of the nozzle surface 30 in the inclined state.

Moreover, by mounting the blade support plate 302 to the blade support plate mounting part 402A, the drip guiding part 302C integrally formed at the lower portion of the tip of the blade support plate 302 is arranged on an inner circumferential side of the receptor 402. Thereby, the waste liquid that drips from the drip guiding part 302C falls into the receptor 402.

A waste liquid outlet 402B is formed at a bottom portion of the receptor 402, and a waste liquid pipe 404 is connected to the waste liquid outlet 402B. The waste liquid pipe 404 is formed to extend vertically downward and is arranged through to the bottom portion of the case main body 126. When the wiping unit 400 is mounted to the wiping unit mounting portion 104, the end (lower end) of the waste liquid pipe 404 is housed in the waste liquid receptor 202 arranged at the wiping unit mounting portion 104. Thus, the waste liquid recovered by the receptor 402 is recovered by the waste liquid receptor 202 through the waste liquid pipe 404.

According to the wiping unit 400 configured as described above, the waste liquid scraped off of the nozzle surface 30 by the blade 300 is guided from the blade 300 to the drip guiding part 302C and drips into the receptor 402. Consequently, the waste liquid can be reliably recovered.

If the drip guiding part 302C is not arranged, since the waste liquid drips from the tip (lower end in the inclination direction) of the blade support plate 302, then the waste liquid cannot be recovered with the receptor 402 having the same depth as the case 112. On the other hand, when the drip guiding part 302C is arranged, the drip position is corrected so that the waste liquid drips inside the receptor 402 (the drip position is corrected so that the waste liquid drips more inward than the lower end in the inclination direction of the blade support plate 302 (which is substantially the same with the lower end in the inclination direction of the blade 300) and into the inside of the receptor 402). Consequently, the waste liquid can be reliably recovered.

Moreover, since the receptor 402 is formed with approximately the same depth as the case 112 and does not stick out from the case 112, compactification of the configuration can be achieved.

While the present embodiment is configured such that the receptor 402 and the blade 300 are mounted to the case main body 126 of the wiping unit 400, with the configuration in which the waste liquid is recovered by the receptor 402, the receptor 402 and the blade 300 may be configured separately from the wiping unit 400.

Furthermore, in the present embodiment, while the depth of the receptor 402 is formed approximately the same as the depth of the case 112, the depth of the receptor 402 is favorably formed smaller than the depth of the case 112 in order to achieve further compactification. Therefore, the receptor 402 is favorably adjusted to an optimal size according to the drip position defined by the drip guiding part 302C.

Other Embodiments

While the embodiments described above are configured such that only a part (the lower end region in the inclination direction) of the nozzle surface 30 is wiped by the blade 300, an alternate configuration may be adopted in which the entire nozzle surface 30 is wiped by the blade. Moreover, since there may be cases where the cleaning liquid finds its way to a side portion of the head when the nozzle surface 30 is inclined, a configuration may be adopted in which the side portion is also wiped by the blade.

In addition, when the configuration is adopted in which the entire nozzle surface is wiped by the blade, wiping by the wiping web may be omitted.

While the drip guiding part 302C is integrally formed with the blade support plate 302 in the embodiments described above, the drip guiding part 302C may be configured separately from the blade support plate 302. In other words, a configuration may be adopted in which the drip guiding part 302C is separately mounted to the blade support plate 302. Alternatively, a configuration may be adopted in which droplets are directly guided from the blade 300.

Moreover, a shape of a member that guides the waste liquid (drip guiding part) is not specifically limited, and any shape may be adopted as long as the shape is capable of guiding the waste liquid so as to drip at a predetermined position. An optimal shape is favorably selected in consideration of a drip position, an installation space, and the like.

Further, in the embodiments described above, the wiping web made of ultra-fine knitted or woven fiber material is used as the wiping web 110, but the composition of the wiping web 110 is not limited to this. It is also possible to use wiping webs having other compositions, provided that they have absorbency. By using a wiping web made of extremely fine knitted or woven fiber material, it is possible to remove adhering material effectively by means of the unevenness of the surface of the wiping web. Moreover, by using the wiping web having absorbency as in the present embodiment, it is possible to draw out the cleaning liquid that has entered into the nozzles or ink of increased viscosity inside the nozzles nearby the nozzle apertures, from the nozzle apertures.

Furthermore, in the embodiments described above, the nozzle surface 30 is wiped while causing the wiping web 110 to travel in the opposite direction to the direction of travel of the nozzle surface 30, but it is also possible to wipe the nozzle surface 30 by causing the wiping web 110 to travel in the same direction as the direction of travel of the nozzle surface 30.

Moreover, in the embodiments described above, the composition is adopted in which the inkjet heads are moved and the cleaning liquid is deposited onto the nozzle surfaces 30 of the moving inkjet heads, but it is also possible to adopt a composition in which the cleaning liquid is deposited onto the nozzle surfaces 30 by moving the cleaning liquid deposition device 62. Further, it is also possible to adopt a composition in which the cleaning liquid is deposited onto the nozzle surfaces 30 by moving both the inkjet heads 16 and the cleaning liquid deposition device 62. Similarly, it is also possible to wipe the nozzle surfaces 30 by moving the wiping device 64. Furthermore, it is also possible to adopt a composition in which the nozzle surfaces 30 are wiped by moving both the inkjet heads 16 and the wiping device 64.

Further, in the embodiments described above, the nozzle surfaces 30 are cleaned in the process of moving the inkjet heads 16 from the maintenance position to the image recording position, but it is also possible to adopt a composition in which the nozzle surfaces 30 are cleaned in the process of moving the inkjet heads 16 from the image recording position to the maintenance position. In this case, the cleaning liquid deposition device 62 is disposed to the image recording position side of the wiping device 64.

Furthermore, in the embodiments described above, the cleaning liquid is deposited on the nozzle surfaces 30 by the cleaning liquid deposition device 62, but the composition for depositing the cleaning liquid onto the nozzle surfaces 30 (the composition for wetting the nozzle surfaces 30) is not limited to this. Apart from this, for example, it is also possible to adopt a composition in which the cleaning liquid is deposited on the nozzle surfaces 30 by a spray, or the like.

Moreover, it is also possible to cover the nozzle surface 30 with the cap 52 and to wet the nozzle surface 30 by sucking. Further, a composition can be adopted in which wiping is performed by a wiping web, without depositing cleaning liquid.

Furthermore, the embodiments described above relate to a case of cleaning the nozzle surface 30 which is arranged at an inclination, but the application of the present invention is not limited to this. It can also be applied similarly to the case of cleaning a nozzle surface which is disposed horizontally.

Moreover, the embodiments described above relate to a case where the nozzle forming region 30A is formed in the recessed shape, but the nozzle forming region 30A may also be formed to the same height as the nozzle protecting regions 30B. In other words, the nozzle surface 30 may be formed in a flat shape.

Furthermore, the embodiments described above relate to a case where the liquid repelling treatment is applied only on the nozzle forming region 30A, but it is also possible to apply a liquid repelling treatment on the nozzle protecting regions 30B as well.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle surface cleaning apparatus configured to clean a nozzle surface of a droplet ejection head while moving relatively with respect to the droplet ejection head, the apparatus comprising:

a cleaning liquid deposition device which deposits cleaning liquid to the nozzle surface;

a blade which is pressed against the nozzle surface to wipe the nozzle surface;

a wiping device which presses a band-shaped wiping web against the nozzle surface to wipe the nozzle surface with the wiping web traveling; and a drip guiding member which guides waste liquid wiped by the blade to drip onto the wiping web, wherein the blade is arranged above a travel pathway of the wiping web, and the drip guiding member causes the waste liquid wiped by the blade to drip onto the wiping web.

2. The nozzle surface cleaning apparatus as defined in claim 1, wherein the droplet ejecting head is arranged with the nozzle surface being inclined.

3. The nozzle surface cleaning apparatus as defined in claim 2, wherein the blade is arranged so as to wipe a lower end region in an inclination direction of the nozzle surface.

4. The nozzle surface cleaning apparatus as defined in claim 1, wherein the drip guiding member is integrally formed with a blade supporting member which supports the blade.

5. A nozzle surface cleaning apparatus configured to clean a nozzle surface of a droplet ejection head while moving relatively with respect to the droplet ejection head, the apparatus comprising:

a cleaning liquid deposition device which deposits cleaning liquid to the nozzle surface;

a blade which is pressed against the nozzle surface to wipe the nozzle surface;

a wiping device which presses a band-shaped wiping web against the nozzle surface to wipe the nozzle surface with the wiping web traveling; and a drip guiding member which guides waste liquid wiped by the blade to drip onto the wiping web, wherein the drip guiding member guides the waste liquid to drip onto the wiping web that has wiped the nozzle surface.

6. The nozzle surface cleaning apparatus as defined in claim 1, wherein the wiping web travels in an opposite direction to a movement direction of the nozzle surface relative to the nozzle surface cleaning apparatus.

7. The nozzle surface cleaning apparatus as defined in claim 5, wherein the droplet ejecting head is arranged with the nozzle surface being inclined.

8. The nozzle surface cleaning apparatus as defined in claim 7, wherein the blade is arranged so as to wipe a lower end region in an inclination direction of the nozzle surface.

9. The nozzle surface cleaning apparatus as defined in claim 5, wherein the drip guiding member is integrally formed with a blade supporting member which supports the blade.

10. The nozzle surface cleaning apparatus as defined in claim 5, wherein the wiping web travels in an opposite direction to a movement direction of the nozzle surface relative to the nozzle surface cleaning apparatus.

* * * * *